US007213905B2

(12) United States Patent
Eguchi

(10) Patent No.: US 7,213,905 B2
(45) Date of Patent: May 8, 2007

(54) LIQUID EJECTING DEVICE

(75) Inventor: Takeo Eguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/109,000

(22) Filed: Apr. 18, 2005

(65) Prior Publication Data

US 2005/0185024 A1 Aug. 25, 2005

Related U.S. Application Data

(63) Continuation of application No. 10/807,440, filed on Mar. 22, 2004, now Pat. No. 6,880,917, which is a continuation of application No. 10/354,762, filed on Jan. 30, 2003, now Pat. No. 6,749,286.

(30) Foreign Application Priority Data

Apr. 16, 2002 (JP) ..... 2002-112947
Nov. 5, 2002 (JP) ..... 2002-320861

(51) Int. Cl.
*B41J 2/16* (2006.01)

(52) U.S. Cl. ..... 347/48; 347/19

(58) Field of Classification Search ..... 347/14, 347/19, 48, 56–59, 61–65, 20, 40, 44
See application file for complete search history.

(56) References Cited

U.S. PATENT DOCUMENTS 4,251,824 A * 2/1981 Hara et al. ..... 347/48
5,172,139 A 12/1992 Sekiya ..... 347/15
5,726,697 A 3/1998 Shimoda ..... 347/62
6,074,046 A 6/2000 Wen ..... 347/68
6,164,748 A 12/2000 Taneya et al. ..... 347/15
6,474,789 B1 11/2002 Ishinaga et al. ..... 347/59

FOREIGN PATENT DOCUMENTS

| | | |
|---|---|---|
| EP | 0816085 | 1/1998 |
| EP | 0997278 | 5/2000 |
| JP | 06-210856 | 8/1994 |
| JP | 048034 | 2/1996 |
| JP | 2003-211666 | 7/2003 |
| WO | WO 01/47713 | 7/2001 |

* cited by examiner

*Primary Examiner*—Juanita D. Stephens
(74) *Attorney, Agent, or Firm*—Robert J. Depke; Rockey, Depke, Lyons & Kitzinger LLC.

(57) ABSTRACT

A liquid ejecting device and method control the flying characteristic of liquid while enabling stable ejection of the liquid, without shortening the life of bubble producing units (heating resistors). The liquid ejecting device has heads each including liquid ejecting portions arranged in parallel which each include a liquid cell, bisected heating resistors in the liquid cell which produce bubbles in liquid in the liquid cell in response to the supply of energy, and a nozzle for ejecting the liquid in the liquid cell by using the bubbles produced by the heating resistors. The heating resistors are supplied with energy, and a difference is set between a manner of supplying energy to one heating resistor and a manner of supplying energy to the other heating resistor. Based on the difference, a flying characteristic of the liquid ejected from the nozzle is controlled.

3 Claims, 18 Drawing Sheets

FIG. 8

| B1 | B2 | CURRENT FLOWING IN Rh-A | CURRENT FLOWING IN Rh-B | RATIO OF Rh-B TO Rh-A | AMOUNT OF DEFLECTION |
|---|---|---|---|---|---|
| 1 | 1 | 1 | 1 | 0 % | REFERENCE |
| 0 | 1 | 1 | 2Rd/(Rh+2Rd) | 2.3 % | 25 % |
| 1 | 0 | 1 | Rd/(Rh+Rd) | 4.6 % | 50 % |
| 0 | 0 | 1 | 2Rd/(3Rh+2Rd) | 6.7 % | 75 % |

| POSITION | (1) | (2) | (3) | (4) | (1) | (2) | (3) | (4) | (1) | (2) | (3) | (4) |
|---|---|---|---|---|---|---|---|---|---|---|---|---|
| B1 | 0 | 1 | 0 | 1 | 0 | 1 | 0 | 1 | 0 | 1 | 0 | 1 |
| B2 | 0 | 0 | 1 | 1 | 0 | 0 | 1 | 1 | 0 | 0 | 1 | 1 |

(1) ONLY BY MAIN OPERATION CONTROLLER (2) BY SUB OPERATION CONTROLLER WOBBLING (3) BY SUB OPERATION CONTROLLER WOBBLING

LIQUID EJECTING DEVICE

The subject matter of application Ser. No. 10/807,440 is incorporated herein by reference. The present application is a continuation of U.S. application Ser. No. 10/807,440, filed Mar. 22, 2004, now issued as U.S. Pat. No. 6,880,917, which is a Continuation of U.S. application Ser. No. 10/354,762, filed Jan. 30, 2003, now issued as U.S. Pat. No. 6,749,236, which claims priority to Japanese Patent Application No. JP2002-112947, filed Apr. 16, 2002, and Japanese Patent Application No. JP2002-320861, filed Nov. 5, 2002. The present application claims priority to these previously filed applications.

BACKGROUND OF THE INVENTION

1. Field of the Invention

The present invention relates to a technology for controlling flying characteristics of liquid or a position to which liquid is delivered and to liquid ejecting device and method in which liquid in liquid cell is ejected from a nozzle. The present invention specifically relates to, in liquid ejecting device including heads each having a plurality of liquid ejecting portions arranged in parallel and liquid ejecting method using the heads each having the ejecting portions arranged in parallel, a technology for controlling a direction (a direction in which liquid is delivered) in which liquid is ejected from each liquid ejecting portion.

2. Description of the Related Art

Inkjet printers have been conventionally known as a type of liquid ejecting device including heads which each have a plurality of liquid ejecting portions arranged in parallel. A thermal method that uses thermal energy to eject ink is known as one of ink ejecting methods for inkjet printers.

In an example of printer-head chip structure using the thermal method, ink in an ink cell is heated by a heating element disposed in the ink cell to produce bubbles in the ink on the heating element, and the energy of the production of the bubbles ejects the ink. A nozzle is formed in the upper side of the ink cell. When the bubbles are produced in the ink in the ink cell, the ink is ejected from the ejecting outlet of the nozzle.

From the viewpoint of head structure, there are two methods, a serial method and a line method. In the serial method, an image is printed by moving a printer-head chip in the width direction of printing paper. In the line method, many printer-chip heads are arranged in the width direction of printing paper to form a line head for the width of the printing paper.

FIG. 18 is a plan view showing a line head 10 of the related art. Although four printer-head chips 1 (N−1, N, N+1, and N+2) are shown in FIG. 18, actually, more printer-head chips are arranged.

In each printer-head chip 1, a plurality of nozzles 1*a* having ejecting outlets for ejecting ink are formed. The nozzles la are arranged in parallel in a given direction, and the given direction is identical to the width direction of the printing paper. Also, the printer-head chips 1 are arranged in the given direction. Adjacent printer-head chips 1 are arranged so that their nozzles 1*a* oppose each other, and in a portion in which two printer-head chips 1 are adjacent to each other, the pitch of the nozzles 1*a* is consecutively maintained (see the detail of portion A in FIG. 18).

The related art shown in FIG. 18 has the following problems.

When ink is ejected from the printer-head chips 1, it is ideal that the ink is ejected perpendicularly to the ejection surface of the printer-head chips 1. However, various factors may cause a case in which an angle at which the ink is ejected is not perpendicular.

For example, when a nozzle sheet having the nozzles 1*a* formed thereon is bonded to the upper side of ink cells having heating elements, the problem is that positional shifting occurs between pairs of the ink cells and the heating elements, and the nozzles 1*a*. When the nozzle sheet is bonded so that the center of the nozzles 1*a* is positioned in the center of the ink cells and the heating elements, the ink is ejected perpendicularly to the ink ejection surface (the nozzle sheet surface). However, if a shift occurs between the ink cells and the heating elements, and the nozzles 1*a*, the ink cannot be ejected perpendicularly to the ejection surface.

Also, a positional shift can occur due to a difference in thermal expansion factor between the pairs of the ink cells and the heating elements, and the nozzle sheet.

It is assumed that, when the ink is ejected perpendicularly to the ejection surface, an ink droplet is delivered to an ideally exact position. When the angle of ejection of the ink is shifted from perpendicularity by θ, positional shift ΔL in delivery of ink droplet is $$\Delta L = H \times \tan\theta$$

with the distance (normally 1 to 2 millimeters in the case of the inkjet method) between the ejection surface and the surface (a surface on which the ink droplet is delivered) of printing paper set to H (H is constant).

When such a shift in angle of ejection of the ink occurs, in the serial method, the shift in angle appears as a shift in delivery of ink between two nozzles 1*a*. In the line method, in addition to the shift in delivery of ink, the shift in angle appears as a positional shift in delivery between two printer-head chips 1.

FIGS. 19A and 19B are respectively a section view and plan view showing the state of printing performed by the line head 10 (in which the printer-head chips 1 are arranged in parallel in a direction in which the nozzles 1*a* are arranged) shown in FIG. 18. In FIGS. 19A and 19B, assuming that printing paper P is fixed, the line head 10 does not move in the width direction of the printing paper P, and performs printing while moving from top to bottom of the plan view in FIG. 19B.

In the section view in FIG. 19A, among the line head 10, three printer-head chips 1, that is, the N-th printer-head chip 1, the (N+1)-th printer-head chip 1, and the (N+2)-th printer-head chip 1 are shown.

As shown in the section view in FIG. 19A, in the N-th printer-head chip 1, ink is slantingly ejected in the left direction as is indicated by the left arrow. In the (N+1)-th printer-head chip 1, ink is slantingly ejected in the right direction as is indicated by the central arrow. In the (N+2)-th printer-head chip 1, ink is perpendicularly ejected without a shift in angle of ejection as is indicated by the right arrow.

Accordingly, in the N-th printer-head chip 1, the ink is delivered, being off to the left from a reference position, and in the (N+1)-th printer-head-chip 1, the ink is delivered, being off to the right from the reference position. Thus, between both, the ink in the N-th printer-head chip 1 and the ink in the (N+1)-th printer-head chip 1 are delivered to opposite directions. As a result, a region in which no ink is delivered is formed between the N-th printer-head chip 1 and the (N+1)-th printer-head chip 1. In addition, the line head 10 is only moved in the direction of the arrow in the plan view in FIG. 19B without being moved in the width direction of the printing paper P. This forms a white stripe B between the N-th printer-head chip 1 and the (N+1) printer-head chip 1, thus causing a problem of deterioration in printing quality.

Similarly to the above case, in the (N+1)-th printer-head chip 1, the ink is delivered, being off to the right from the reference position. Thus, the (N+1)-th printer-head chip 1 and the (N+2)-th printer-head chip 1 have a common region in which the ink is delivered. This causes a discontinuous image and a stripe C which has a color thicker than the original color, thus causing a problem of deterioration in printing quality.

When such a shift in a position to which ink is delivered occurs, the degree to which a stripe looks noticeable depends on an image to be printed. For example, since a document or the like has many blank portions, a stripe will not look noticeable if it is formed. Conversely, in the case of printing a photograph image in almost all the portions of printing paper, if a slight strip is formed, it will look noticeable.

For the purpose of preventing the formation of such a stripe, Japanese Patent Application No. 2001-44157 (hereinafter referred to as "Earlier Application 1") has been filed by the Assignee of the present Patent Application. In the invention of Earlier Application 1, a plurality of heating elements (heaters) which can separately be driven are provided in ink cells, and by separately driving the heating elements, a direction in which each ink droplet is ejected can be changed. Accordingly, it has been thought that the formation of the above stripe (the white stripe B or the stripe C) can be prevented by the Earlier Application 1.

However, although Earlier Application 1 deflects the ink droplet by separately controlling the heating elements, the result of further study by the present Inventors has indicated that, when the method of Earlier Application 1 is employed, the ejection of the ink droplet may become unstable and a printed image having high quality cannot stably be obtained. The reason is described below.

According to study by the present Inventors, as described in PCT/JP/08535 (hereinafter referred to as "Earlier Application 2") filed by the Assignee of the present Application, normally, the quantity of ejection of ink from nozzles does not increase in a monotone in accordance with an increase in power applied to heating elements, but tends to rapidly increase when the power exceeds a predetermined value (see Earlier Application 2, page 28, lines 14 to 17, and FIG. 18). In other words, a sufficient quantity of ink droplet cannot be ejected unless power equal to the predetermined value or greater is supplied.

Therefore, in the case of separately driving the heating elements, when ink droplets are ejected by performing only driving of only some heating elements, a sufficient amount of heat for ink droplet ejection must be generated only by the driving. Accordingly, in the case of separately driving the heating elements, when some heating elements are used to eject the ink droplets, power supplied to the heating elements must be increased. This situation causes a disadvantageous situation to size reduction in the heating element which is associated with increased resolution in the recent years.

In other words, in order to perform stable ejection of ink droplets, the amount of generated energy per unit area of each heating element must be extremely increased than usual. As a result, damage to small-sized heating elements is enhanced. This shortens the life of the heating elements, thus shortening the life of the head.

The above problems are similarly found in the case of using the technologies described in Japanese Patent No. 2780648 (hereinafter referred to as "Earlier Application 3") and Japanese Patent No. 2836749 (hereinafter referred to as "Earlier Application 4").

Although Earlier Application 3 discloses an invention for preventing a satellite (scattering of ink), and Earlier Application 4 discloses an invention for the purpose of realizing stable control of gradations, both are similar to Earlier Application 1 in using a plurality of heating elements and separately driving the heating elements.

By driving some heating elements among a plurality of heating elements to eject ink droplets, as in Earlier Applications 3 and 4, the ink droplets can be ejected and deflected as described in Earlier Application 3, or gradation control can be performed as described in Earlier Application 4. However, in the case of using provided heating elements which are small-sized in association with increased resolution in the recent years, when only some heating elements are driven to eject ink droplets, the supply to them of power enabling stable ejection causes a problem of a decrease in the life of the heating elements.

In the invention in Earlier Application 4, an increase in the amount of power to each heating element represents an increase in the minimum quantity of ink droplet. Thus, it is difficult to perform gradation control which is the original object of the invention in Earlier Application 4.

Conversely, in Earlier Application 4, when the amount of power supplied to each heating element is reduced, there is a possibility that the ink droplets cannot stably be ejected, as described above.

As is understood from the above description, in the case of using a head including heating elements which are small-sized in association with increased resolution, it is impossible to prevent the formation of the above stripes by the related art and the technologies in Earlier Applications 1 to 4.

SUMMARY OF THE INVENTION

Accordingly, it is an object of the present invention to perform stable ejection of liquid without shortening the life of means of producing bubbles, such as heating elements, and to control the flying characteristic of the liquid or a position to which the liquid is delivered. Specifically, the object is to control a direction in which liquid is ejected, for example, in a liquid ejecting device having heads each including a plurality of liquid ejecting portions arranged in parallel and a liquid ejecting method using heads each including a plurality of liquid ejecting portions arranged in parallel.

According to a first aspect of the present invention, a liquid ejecting device is provided which includes a liquid cell for containing liquid, a plurality of bubble producing units for producing bubbles in the liquid in the liquid cell in response to supply of energy, and a nozzle for ejecting the liquid in the liquid cell by using the bubbles produced by the bubble producing units. The bubble producing units are disposed in the liquid cell, and all the bubble producing units in the liquid cell are supplied with energy, and by setting a difference between a manner of supplying energy to at least one of the bubble producing units and a manner of supplying energy to another one of the bubble producing units, a flying characteristic of the liquid ejected from the nozzle is controlled based on the difference.

According to a second aspect of the present invention, a liquid ejecting device is provided which includes a liquid cell for containing liquid, a plurality of bubble producing units for producing bubbles in the liquid in the liquid cell in response to supply of energy, and a nozzle for ejecting the liquid in the liquid cell by using the bubbles produced by the bubble producing units. The bubble producing units are disposed in the liquid cell, and all the bubble producing units in the liquid cell are supplied with energy, and by performing energy supply so that a difference is set between the time required for generating a bubble in the liquid by at least one of the bubble producing units, and the time required for generating a bubble in the liquid by another one of the bubble producing units, a flying characteristic of the liquid ejected from the nozzle is controlled based on the difference.

According to a third aspect of the present invention, a liquid ejecting device is provided which includes a liquid cell for containing liquid, a bubble producing region which produces a bubble in the liquid in the liquid cell in response to supply of energy and which forms at least part of one internal wall of the liquid cell, and a nozzle for ejecting the liquid in the liquid cell by the bubble produced by the bubble producing region. An energy distribution in the bubble producing region which is obtained when the energy is supplied to the bubble producing region has a difference, and based on the difference, a flying characteristic of the liquid ejected from the nozzle is controlled.

According to a fourth aspect of the present invention, a liquid ejecting device is provided which includes a liquid cell for containing liquid, a plurality of bubble producing units for producing bubbles in the liquid in the liquid cell in response to supply of energy, and a nozzle for ejecting the liquid in the liquid cell by using the bubbles produced by the bubble producing units. The bubble producing units are disposed in the liquid cell, and the bubble producing units comprises: a main operation-control unit for ejecting liquid from the nozzle by supplying the energy to all the bubble producing units; and a sub operation-control unit which supplies the energy to all the bubble producing units and which, by setting a difference between a manner of supplying energy to at least one of the bubble producing units and a manner of supplying energy to another one of the bubble producing units, uses the nozzle to perform ejection based on the difference of liquid having a flying characteristic different from that of the liquid ejected by the main operation-control unit.

According to a fifth aspect of the present invention, a liquid ejecting device is provided which includes a liquid cell for containing liquid, a plurality of bubble producing units for producing bubbles in the liquid in the liquid cell in response to supply of energy, and a nozzle for ejecting the liquid in the liquid cell by using the bubbles produced by the bubble producing units. The bubble producing units are disposed in the liquid cell, and the bubble producing units comprise: a main operation-control unit for ejecting liquid from the nozzle by supplying the energy to all the bubble producing units; and a sub operation-control unit which supplies the energy to all the bubble producing units and which, by setting a difference between a manner of supplying energy to at least one of the bubble producing units and a manner of supplying energy by the main operation-control unit, uses the nozzle to perform ejection based on the difference of liquid having a flying characteristic different from that of the liquid ejected by the main operation-control unit.

According to a sixth aspect of the present invention, a liquid ejecting device is provided which includes a liquid cell for containing liquid, a bubble producing region which produces a bubble in the liquid in the liquid cell in response to supply of energy and which forms at least part of one internal wall of the liquid cell, a nozzle for ejecting the liquid in the liquid cell by the bubble produced by the bubble producing region, a main operation-control unit which ejects liquid from the nozzle by supplying energy to the bubble producing region, and a sub operation-control unit which, by setting a difference in an energy distribution in the bubble producing region which is obtained when the energy is supplied to the bubble producing region, uses the nozzle to perform ejection based on the difference of liquid having a flying characteristic different from that of the liquid ejected by the main operation-control unit.

According to a seventh aspect of the present invention, a liquid ejecting method is provided which, by using a plurality of bubble producing units in a liquid cell to produce bubbles in liquid contained in the liquid cell by supplying energy to the bubble producing units, ejects the liquid from a nozzle by using the produced bubbles. The liquid ejected from the nozzle is controlled to have at least two different characteristics by using: a main operation-control step in which the liquid is ejected from the nozzle by supplying uniform energy to all the bubble producing units in the liquid cell; and a sub operation-control step in which energy is supplied to all the bubble producing units in the liquid cell and in which, by setting a difference between a manner of supplying energy to at least one of the bubble producing units and a manner of supplying energy to another one of the bubble producing units, the liquid ejected from the nozzle is controlled based on the difference to have a flying characteristic different from that of the liquid ejected in the main operation-control step.

According to an eighth aspect of the present invention, a liquid ejecting method is provided which, by using a plurality of bubble producing units in a liquid cell to produce bubbles in liquid contained in the liquid cell by supplying energy to the bubble producing units, ejects the liquid from a nozzle by using the produced bubbles. The liquid ejected from the nozzle is controlled to have at least two different characteristics by using: a main operation-control step which ejects the liquid from the nozzle by supplying energy to all the bubble producing units in the liquid cell; and a sub operation-control step which supplies the energy to all the bubble producing units and which, by setting a difference between a manner of supplying energy to at least one of the bubble producing units and a manner of supplying energy in the main operation-control step, uses the nozzle to perform ejection based on the difference of liquid having a flying characteristic different from that of the liquid ejected in the main operation-control step.

According to a ninth aspect of the present invention, a liquid ejecting method is provided which, by using a bubble producing region forming at least part of one internal wall of a liquid cell to produce a bubble in liquid contained in the liquid cell, ejects the liquid from a nozzle by using the produced bubble. The liquid ejected from the nozzle is controlled to have at least two flying characteristics by using: a main operation-control step in which, by supplying energy so that an energy distribution in the bubble producing region is uniform, liquid is ejected from the nozzle; and a sub operation-control step in which, by setting a difference in the energy distribution in the bubble producing region when energy is supplied to the bubble producing region, a flying characteristic of the liquid ejected from the nozzle is controlled based on the difference to differ from that of the liquid ejected in the main operation-control step.

According to a tenth aspect of the present invention, a liquid ejecting device is provided which includes a liquid cell for containing liquid, a plurality of bubble producing units for producing bubbles in the liquid in the liquid cell in response to supply of energy, and a nozzle for ejecting the liquid in the liquid cell by using the bubbles produced by the bubble producing units. The bubble producing units are disposed in the liquid cell, and all the bubble producing units in the liquid cell are supplied with energy, and by setting a difference between a manner of supplying energy to at least one of the bubble producing units and a manner of supplying energy to another one of the bubble producing units, the liquid ejected from the nozzle is controlled based on the difference to be delivered to at least two different positions.

According to an eleventh aspect of the present invention, a liquid ejecting device is provided which includes a liquid cell for containing liquid, a plurality of bubble producing units for producing bubbles in the liquid in the liquid cell in response to supply of energy, and a nozzle for ejecting the liquid in the liquid cell by using the bubbles produced by the bubble producing units. The bubble producing units are disposed in the liquid cell. All the bubble producing units in the liquid cell are supplied with energy, and by performing energy supply so that a difference is set between the time required for generating a bubble in the liquid by at least one of the bubble producing units, and the time required for generating a bubble in the liquid by another one of the bubble producing units, the liquid ejected from the nozzle is controlled based on the difference to be delivered to at least two different positions.

According to a twelfth aspect of the present invention, a liquid ejecting device is provided which includes a liquid cell for containing liquid, a bubble producing region which produces a bubble in the liquid in the liquid cell in response to supply of energy and which forms at least part of one internal wall of the liquid cell, and a nozzle for ejecting the liquid in the liquid cell by using the bubble produced by the bubble producing region. An energy distribution in the bubble producing region which is obtained when the energy is supplied to the bubble producing region has a difference, and based on the difference, the liquid ejected from the nozzle is controlled to be delivered to at least two different positions.

According to a thirteenth aspect of the present invention, a liquid ejecting device is provided which includes a liquid cell for containing liquid, a plurality of bubble producing units for producing bubbles in the liquid in the liquid cell in response to supply of energy, and a nozzle for ejecting the liquid in the liquid cell by using the bubbles produced by the bubble producing units. The bubble producing units are disposed in the liquid cell, and the bubble producing units comprise: a main operation-control unit for ejecting liquid from the nozzle by supplying energy to all the bubble producing units; and a sub operation-control unit which supplies the energy to all the bubble producing units and which, by setting a difference between a manner of supplying energy to at least one of the bubble producing units and a manner of supplying energy to another one of the bubble producing units, performs control based on the difference of the liquid ejected from the nozzle to be delivered to a position different from a position to which the liquid ejected by the main operation-control unit is delivered.

According to a fourteenth aspect of the present invention, a liquid ejecting device is provided which includes a liquid cell for containing liquid, a plurality of bubble producing units for producing bubbles in the liquid in the liquid cell in response to supply of energy, and a nozzle for ejecting the liquid in the liquid cell by using the bubbles produced by the bubble producing units. The bubble producing units are disposed in the liquid cell, and the bubble producing units comprise: a main operation-control unit for ejecting liquid from the nozzle by supplying the energy to all the bubble producing units; and a sub operation-control unit which supplies energy to all the bubble producing units and which, by setting a difference between a manner of supplying energy to at least one of the bubble producing units and a manner of supplying energy by the main operation-control unit, controls the liquid ejected from the nozzle to be delivered to a position different from a position to which liquid ejected by the main operation-control unit is delivered.

According to a fifteenth aspect of the present invention, a liquid ejecting device is provided which includes a liquid cell for containing liquid, a bubble producing region for producing a bubble in the liquid in the liquid cell in response to supply of energy, the bubble producing region forming at least part of one internal wall of the liquid cell, a nozzle for ejecting the liquid in the liquid cell by using the bubble produced by the bubble producing region, a main operation-control unit which ejects liquid from the nozzle by supplying energy to the bubble producing region, and a sub operation-control unit which, by setting a difference in an energy distribution in the bubble producing region which is obtained when the energy is supplied to the bubble producing region, controls the liquid ejected from the nozzle to be delivered to a position different from a position to which the liquid ejected by the main operation-control unit is delivered.

According to a sixteenth aspect of the present invention, a liquid ejecting method is provided which, by using a plurality of bubble producing units in a liquid cell to produce bubbles in liquid contained in the liquid cell by supplying energy to the bubble producing units, ejects the liquid from a nozzle by using the produced bubbles. The liquid ejected from the nozzle is controlled to be delivered to at least two different positions by using: a main operation-control step in which the liquid is ejected from the nozzle by supplying uniform energy to all the bubble producing units in the liquid cell; and a sub operation-control step in which all the bubble producing units in the liquid cell are supplied with energy and in which, by setting a difference between a manner of supplying energy to at least one of the bubble producing units-and a manner of supplying energy to another one of the bubble producing units, the liquid ejected from the nozzle is controlled based on the difference to be delivered to a position different from a position to which the liquid ejected by the main operation-control step is delivered.

According to a seventeenth aspect of the present invention, a liquid ejecting method is provided which, by using a plurality of bubble producing units in a liquid cell to produce bubbles in liquid contained in the liquid cell by supplying energy to the bubble producing units, ejects the liquid from a nozzle by using the produced bubbles. The liquid ejected from the nozzle is controlled to be delivered to at least two different positions by using: a main operation-control step in which the liquid is ejected from the nozzle by supplying uniform energy to all the bubble producing units in the liquid cell; and a sub operation-control step in which all the bubble producing units in the liquid cell are supplied with energy and in which, by setting a difference between a manner of supplying energy to at least one of the bubble producing units and a manner of supplying the energy in the main operation-control step, the liquid ejected from the nozzle is controlled based on the difference to be delivered to a position different from a position to which the liquid ejected in the main operation-control step is delivered.

According to an eighteenth aspect of the present invention, a liquid ejecting method for ejecting liquid in a liquid cell from a nozzle by using a bubble produced in the liquid by supplying energy to a bubble producing region in the liquid cell is provided. The bubble producing region forms at least part of one internal wall of the liquid cell. The liquid ejected from the nozzle is controlled to be delivered to at least two different positions by using: a main operation-control step in which, by supplying the energy to the bubble producing region so that energy distribution in the bubble producing region is uniform, the liquid is ejected from the nozzle; and a sub operation-control step in which, by setting an energy distribution in the bubble producing which is obtained when the energy is supplied to the bubble producing region to have a difference, the liquid ejected from the nozzle is controlled to be delivered to a position different from a position to which the liquid ejected in the main operation-control step is delivered.

According to a nineteenth aspect of the present invention, a liquid ejecting device having heads each including a plurality of liquid ejecting portions arranged in parallel in a predetermined direction is provided. The liquid ejecting portions each include a liquid cell for containing liquid, a plurality of heating elements for producing bubbles in response to the supply of energy, and a nozzle for ejecting the liquid in the liquid cell by using the bubbles produced by the heating elements. The heating elements are arranged in the predetermined direction in the liquid cell. All the heating elements in the liquid cell are supplied with energy and by setting a difference between a manner of supplying energy to at least one of the heating elements and a manner of supplying energy to another one of the heating elements, a direction in which the liquid is ejected from the nozzle is controlled based on the difference.

According to a twelfth aspect of the present invention, a liquid ejecting device having heads each including a plurality of liquid ejecting portions arranged in parallel in a predetermined direction is provided. The liquid ejecting portions each include a liquid cell for containing liquid, a plurality of heating elements for producing bubbles in response to the supply of energy, and a nozzle for ejecting the liquid in the liquid cell by using the bubbles produced by the heating elements. The heating elements are arranged in the predetermined direction in the liquid cell. All the heating elements in the liquid cell are supplied with energy, and by performing energy supply so that a difference is set between the time required for generating a bubble in part of the liquid by at least one of the heating elements, and the time required for generating a bubble in another part of the liquid by another one of the heating elements, a direction in which the liquid is ejected from the nozzle is controlled based on the difference.

According to a twenty-first aspect of the present invention, a liquid ejecting device having heads each including a plurality of liquid ejecting portions arranged in parallel in a predetermined direction is provided. The liquid ejecting portions each include a liquid cell for containing liquid, a plurality of heating elements for producing bubbles in response to the supply of energy, and a nozzle for ejecting the liquid in the liquid cell by using the bubbles produced by the heating elements. The heating elements are arranged in the predetermined direction in the liquid cell. For each of the heads, energy is supplied to all the heating elements in the liquid cell, and by setting a difference between a manner of supplying energy to at least one of the heating elements and a manner of supplying energy to another one of the heating elements, a direction in which the liquid is ejected from the nozzle is controlled based on the difference.

According to a twenty-second aspect of the present invention, a liquid ejecting device having heads each including a plurality of liquid ejecting portions arranged in parallel in a predetermined direction is provided. The liquid ejecting portions each include a liquid cell for containing liquid, a plurality of heating elements for producing bubbles in response to the supply of energy, and a nozzle for ejecting the liquid in the liquid cell by using the bubbles produced by the heating elements. The heating elements are arranged in the predetermined direction in the liquid cell. For each of the heads, energy is supplied to all the heating elements in the liquid cell, and by performing energy supply so that a difference is set between the time required for generating a bubble in part of the liquid by at least one of the heating elements, and the time required for generating a bubble in another part of the liquid by another one of the heating elements, a direction in which the liquid is ejected from the nozzle is controlled based on the difference.

According to a twenty-third aspect of the present invention, a liquid ejecting method using heads each including a plurality of liquid ejecting portions arranged in parallel in a predetermined direction is provided. The liquid ejecting portions each include a liquid cell for containing liquid, a plurality of heating elements for producing bubbles in response to the supply of energy, the heating elements being arranged in the predetermined direction in the liquid cell, and a nozzle for ejecting the liquid in the liquid cell by using the bubbles produced by the heating elements. All the heating elements in the liquid cell are supplied with energy, and by setting a difference between a manner of supplying energy to at least one of the heating elements and a manner of supplying energy to another one of the heating elements, a direction in which the liquid is ejected from the nozzle is controlled based on the difference.

According to a twenty-fourth aspect of the present invention, a liquid ejecting method using heads each including a plurality of liquid ejecting portions arranged in parallel in a predetermined direction is provided. The liquid ejecting portions each include a liquid cell for containing liquid, a plurality of heating elements for producing bubbles in response to the supply of energy, the heating elements being arranged in the predetermined direction in the liquid cell, and a nozzle for ejecting the liquid in the liquid cell by using the bubbles produced by the heating elements. All the heating elements in the liquid cell are supplied with energy, and by performing energy supply so that a difference is set between the time required for generating a bubble in part of the liquid by at least one of the heating elements, and the time required for generating a bubble in another part of the liquid by another one of the heating elements, a direction in which the liquid is ejected from the nozzle is controlled based on the difference.

According to the present invention, by ejecting liquid having a first flying characteristic, and setting a difference or time difference in the supply of energy or energy distribution, liquid having a second flying characteristic different from the first flying characteristic can be ejected. Therefore, liquid ejected from a single nozzle can be controlled to have one of a plurality of flying characteristics.

According to the present invention, by delivering liquid to a first position, and setting a difference or time difference in the supply of energy or energy distribution, liquid ejected from a single nozzle can be delivered to one of a plurality of positions.

According to the present invention, for example, when a plurality of heating resistors in a liquid cell have no equal resistances, by setting a difference in supplying energy to the heating resistors, the time required for producing a bubble on each heating resistor can be set to be equal. This can eliminate a shift in a direction in which liquid is ejected.

Accordingly, for example, when there is a shift in position of delivered liquid for two adjacent liquid ejecting portions, by setting a difference in supplying energy to the heating resistors for one or both liquid ejecting portions, the times required for producing bubbles on the heating resistors can be controlled to differ. This can change the direction in which the liquid is ejected and can adjust the interval between positions to which the liquid can be delivered.

In addition, by changing the direction in which each liquid ejecting portion ejects liquid, for example, for each line, or within one line, by appropriately changing directions in which some liquid ejecting portions eject liquid, printed image quality can be increased.

BRIEF DESCRIPTION OF THE DRAWINGS

FIG. 8 is a table showing results obtained in the circuit shown in FIG. 7;

DESCRIPTION OF THE PREFERRED EMBODIMENTS

An embodiment of the present invention is described below with reference to the accompanying drawings.

Figure 1:
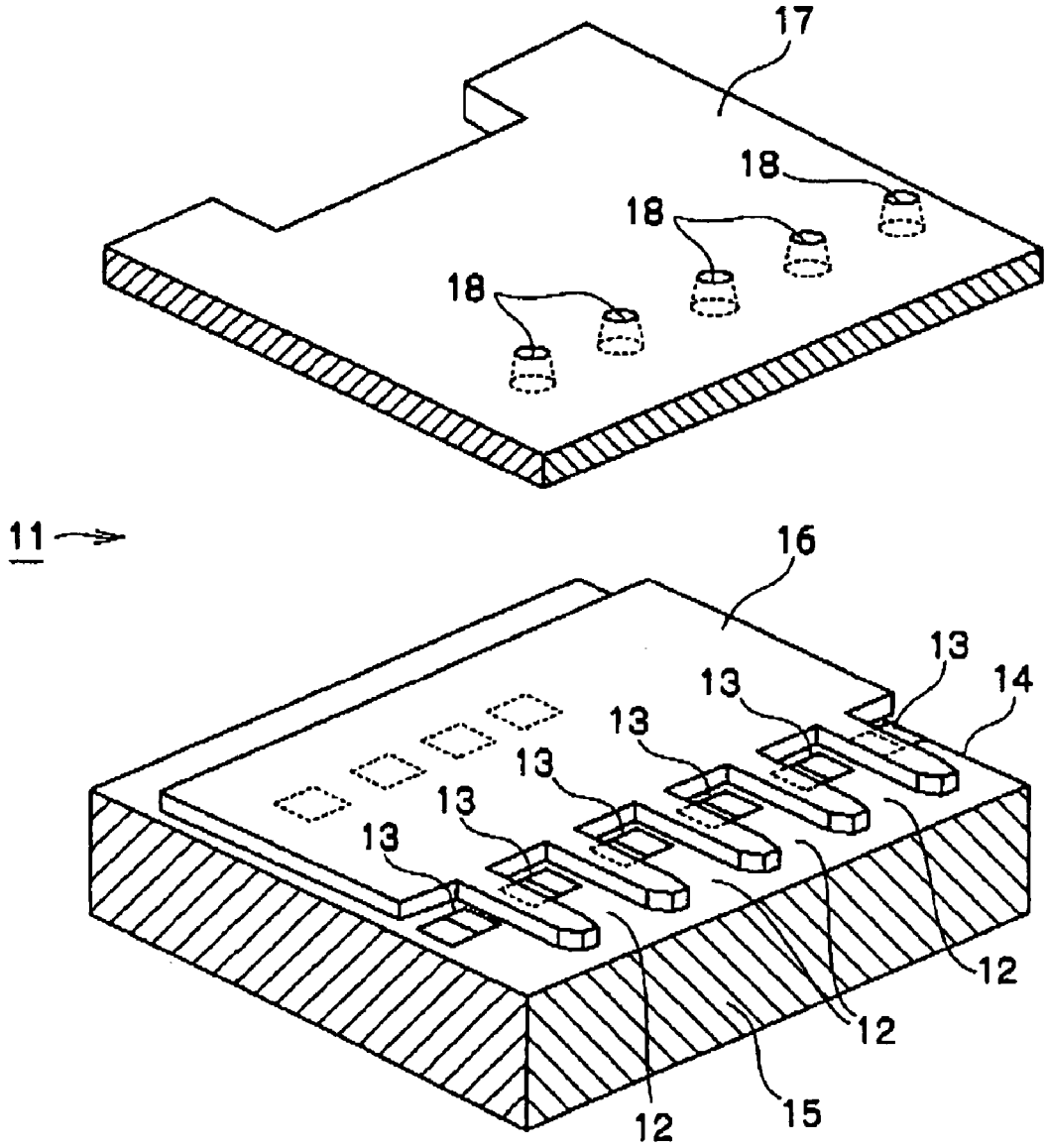
FIG. 1 is an exploded perspective view showing a printer-head chip to which a liquid ejecting device of the present invention is applied.

FIG. 1 is an exploded perspective view showing a printer-head chip 11 to which a liquid ejecting device of the present invention is applied. In FIG. 1, a nozzle sheet 17 is bonded to a barrier layer 16. The nozzle sheet 17 is shown, with it separated.

The printer-head chip 11 is of a type using the above thermal method. In the printer-head chip 11, a base member 14 includes a semiconductor substrate composed of silicon, etc., and heating resistors 13 (which correspond to bubble producing units or heating elements in the present invention, and which are used to produce bubbles in a liquid when being supplied with energy) formed on one surface of the semiconductor substrate 15. The heating resistors 13 are electrically connected to an external circuit by a conductor portion (not shown) formed on the semiconductor substrate 15.

The barrier layer 16 is made of a photosensitive cyclized rubber resist or an exposure-curing dry-film resist, and is formed by stacking the resist on the entirety of the surface of the semiconductor substrate 15 on which the heating resistors 13 are formed, and using a photolithography process to remove unnecessary portions.

The nozzle sheet 17 has therein a plurality of nozzles 18 having ejecting portions, and is formed by, for example, electroforming technology using nickel. The nozzle sheet 17 is bonded onto the barrier layer 16 so that the positions of the nozzles 18 can correspond to the positions of the heating resistors 13, that is, the nozzles 18 can oppose the heating resistors 13.

Ink cells 12 are constituted so as to surround the heating resistors 13 by the substrate member 14, the barrier layer 16, and the nozzle sheet 17. Specifically, the substrate member 14 forms the bottom walls of the ink cells 12, the barrier layer 16 forms the side walls of the ink cells 12, and the nozzle sheet 17 forms the top walls of the ink cells 12. In this structure, the ink cells 12 have aperture regions in the front right of FIG. 1. The aperture regions are connected to ink-flow paths (not shown).

The above printer-head chip 11 normally includes the heating resistors 13 in units of hundreds, and the ink cells 12 provided with the heating resistors 13. In response to a command from the control unit of the printer, each heating resistor 13 is uniquely selected, and the ink of the ink cell 12 corresponding to the heating resistor 13 can be ejected from the nozzle 18 opposing the ink cell 12.

In other words, in the printer-head chip 11, the ink cell 12 is filled with ink supplied from an ink container (not shown) joined to the head 11. By allowing a pulse current to flow through the heating resistor 13 in a short time, for example, 1 to 3 microseconds, the heating resistor 13 is rapidly heated. As a result, a gas-phase ink bubble is produced in a portion touching the heating resistor 13, and the expansion of the ink bubble dislodges ink of some volume (the ink boils). In this manner, ink of a volume equal to that of the dislodged ink in the portion touching the nozzle 18 is ejected as ink droplets from the nozzle 18, and is delivered onto the printing paper.

Figure 2A:
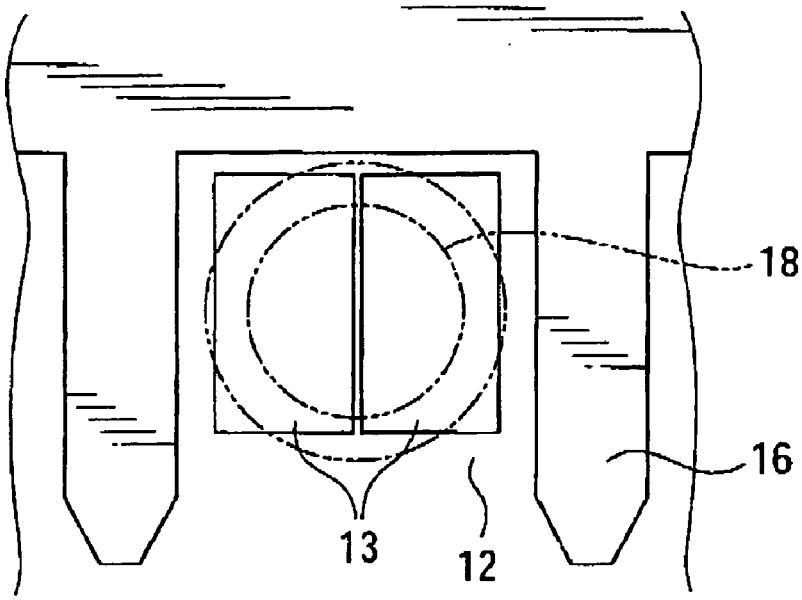
FIGS. 2A and 2B are a detailed plan view and side view showing the arrangement of heating resistors in the printer-head chip shown in FIG. 1.
Figure 2B:
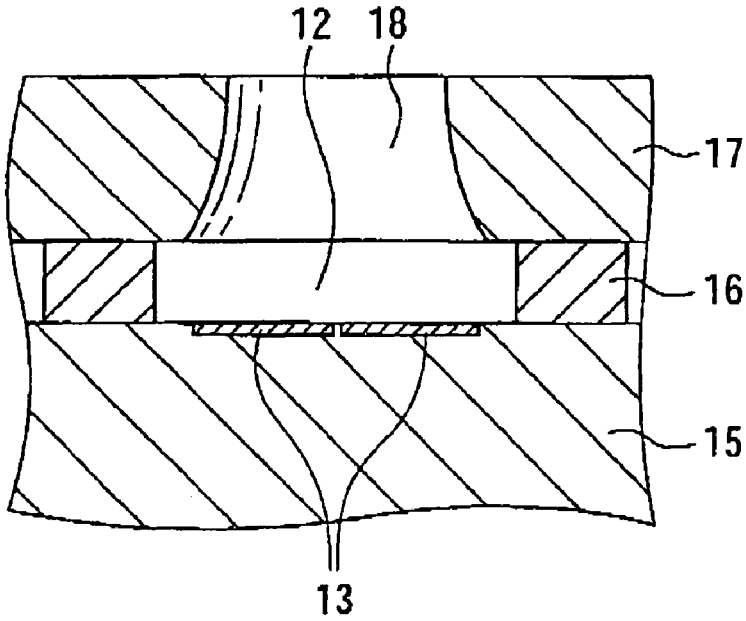

FIGS. 2A and 2B are respectively a detailed plan view and side sectional view showing the arrangement of the heating resistors 13 in the head 11. In the plan view in FIG. 2A, the position of the nozzle 18 is indicated by the chain lines.

As shown in FIGS. 2A and 2B, in the head 11 in this embodiment, one ink cell 12 includes two separate heating resistors 13 arranged in parallel. In other words, the ink cell 12 includes bisected heating resistors 13. The direction in which the heating resistors 13 are arranged is a direction (the horizontal direction in FIGS. 2A and 2B) in which the nozzles 18 are arranged.

In such a bisected type in which one heating resistor 13 is longitudinally separated, each separated heating resistor 13 has the same length and a half width. Thus, the resistance of the separated heating resistors 13 is double that of the original heating resistor 13. By connecting the separated heating resistors 13 in series, the separated heating resistors 13 having the double resistances are connected in series, so that the total resistance is four times that of the original heating resistor 13.

Here, in order that the ink in the ink cell 12 may boil, the heating resistors 13 must be heated by supplying a certain amount of power to them. This is because energy generated at the boil is used to eject the ink. When the resistance is small, a current to pass must be increased. However, by increasing the resistance of the heating resistors 13, the ink can be brought to a boil with a small current.

This can also reduce the size of a transistor or the like for passing the current, thus achieving a reduction in occupied space. By reducing the thickness of the heating resistors 13, the resistance can be increased. However, when considering material selected for the heating resistors 13 and its strength (durability), there is a limitation in reducing the thickness of the heating resistors 13. Accordingly, by separating the heating resistor 13 without reducing its thickness, the resistance of the heating resistors 13 is increased.

When one ink cell 12 includes the bisected heating resistors 13, it is common that the time (bubble producing time) required for each heating resistor 13 to reach a temperature for boiling the ink is set to be equal.

The bisected resistors 13 are physically not identical in shape. Due to an error in production, it is common that a dimension such as thickness changes. This causes a difference in bubble producing time. The creation of the difference in bubble producing time may cause a case in which the ink on one heating resistor 13 and the ink on the other heating resistor 13 do not boil.

When the difference in bubble producing time is created, the angle of ejection of ink is not perpendicular, and a position to which ink is delivered is off the correct position.

Figure 3A:
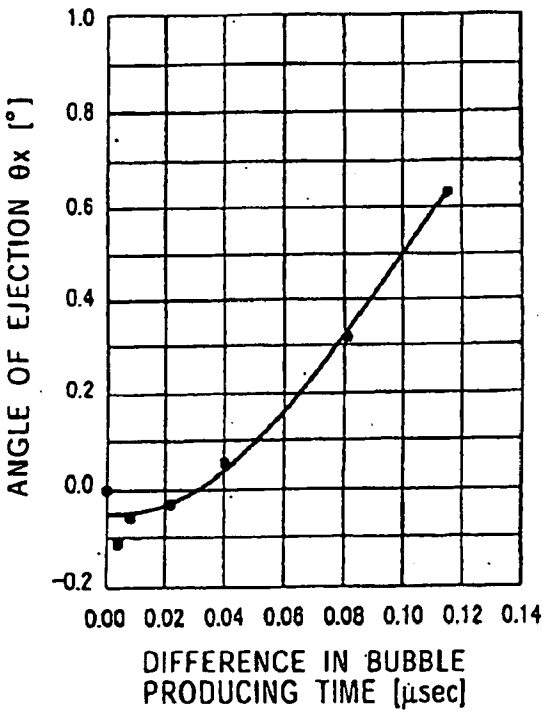
FIGS. 3A and 3B are graphs showing the relationship obtained in the case of each separate heating resistor 13 as in this embodiment between a difference in bubble producing time of ink and the ejection angle of ink droplets.
Figure 3B:
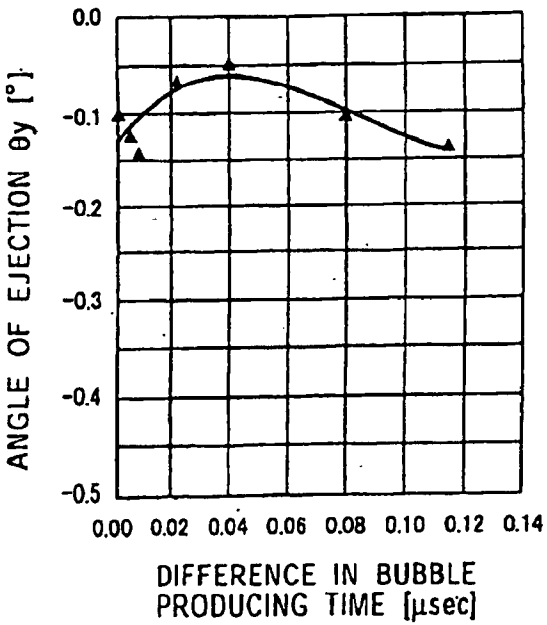

FIGS. 3A and 3B are graphs showing relationships obtained in the case of each separate heating resistor 13 as in this embodiment between a difference in bubble producing time of ink and the ejection angle of-ink droplet. The values shown in the graphs are computer-simulated results. In each graph, the X-direction indicates a direction (the direction of the heating resistors 13 arranged in parallel) in which the nozzles 18 are arranged. The Y-direction indicates a direction perpendicular to the X-direction, which is a direction in which the printing paper is carried.

Regarding the data in both graphs, the horizontal axis indicates difference in bubble producing time. In FIGS. 3A and 3B, a time difference of 0.04 microseconds corresponds to a variation of a 3-percent resistance difference, and a time difference of 0.08 seconds corresponds to a variation of approximately a 6-percent resistance difference.

As described above, when difference in bubble producing time is created, the angle of ejection of ink is not perpendicular. Thus, the position to which ink is delivered is off the correct position.

Accordingly, in this embodiment, by using the above characteristic, the bubble producing times of the heating resistors 13 are controlled.

In the present invention, means of ejecting an ink droplet from the nozzle 18 by supplying (uniform) energy to all of heating resistors 13 in one ink cell 12 is referred to as a "main operation controller". In other words, control for ejecting an ink droplet from the nozzle 18 is referred to as the "main operation controller". The control is performed such that, as in this embodiment, when one ink cell 12 includes bisected heating resistors 13, the simultaneous supply of equal amounts of energy (power) brings ink on the heating resistors 13 to a boil so that the time required for each heating resistor 13 to have a temperature for bringing the ink to a boil can be theoretically equal, in other words, an angle at which the ink is ejected can be perpendicular to a surface onto which the ink is delivered.

Unlike this, means in which, by supplying energy to the heating resistors 13 so that a difference is set between the time required for at least one of the heating resistors 13 to produce a bubble and the time required for at least one other one of the heating resistors 13 to produce a bubble, thereby setting a difference between a manner of supplying energy to the at least one heating resistor 13 and a manner of supplying energy to the at least one other one heating resistor 13, or by controlling the manner of supplying the at least one heating resistor 13 to differ from that by the main operation controller, the use of the difference ejects, from the nozzle 18, an ink droplet having a flying characteristic (such as a flying direction, a flying path, or rotation moment of a flying ink droplet) different from that of an ink droplet ejected by the main operation controller, in other words, means for controlling the ink droplet ejected from the nozzle 18 to be delivered to a position to which an ink droplet ejected by the main operation controller is delivered is referred to as a "sub operation controller". However, the sub operation controller is identical to the main operation controller in supplying energy to all the heating resistors 13 in the ink cell 12.

Accordingly, for example, when the resistances of the bisected heating resistors 13 have an error and differ, the heating resistors 13 have a difference in bubble producing time. Thus, the use of only the main operation controller shifts the angle at which the ink is ejected from perpendicularity, so that the position to which the ink droplet is delivered is off from the correct position. However, by using the sub operation controller to control each heating resistor 13 to have an equal bubble producing time, the angle at which the ink is ejected can be set at perpendicularity.

Figure 4:
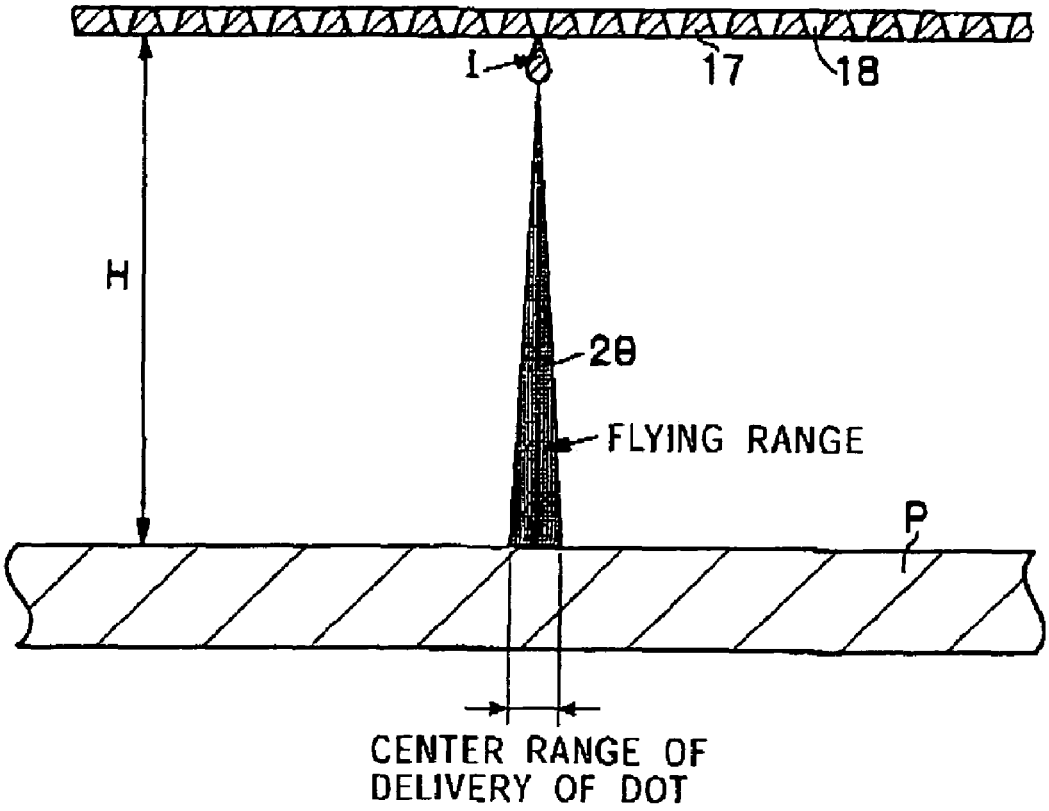
FIG. 4 is a side sectional view showing the relationship between nozzles and printing paper.

Next, setting of the adjustment of the angle of ejection of ink is described below with reference to FIG. 4. FIG. 4 is a side sectional view showing the relationship between the nozzles 18 and printing paper P.

Although the distance H between the tips of the nozzles 18 and the printing paper P is approximately 1 to 2 millimeters in the case of an ordinary inkjet printer, it is here assumed that the distance H is maintained at a constant value, namely, approximately 2 millimeters. The reason the distance H must be maintained at approximately the constant value is because a change in the distance H changes the position to which the ink droplet is delivered. In other words, when an ink droplet is ejected perpendicularly to the surface of the printing paper P, the position to which the ink droplet is delivered does not change, even if the distance H changes to some degree. Conversely, when the ink droplet is ejected and deflected, with its flying characteristic changed, the position to which the ink droplet is delivered changes in accordance with the change in the distance H.

When the resolution of the printer-head chip 11 is 600 dpi, the interval (dot interval) between positions to which each ink droplet i is delivered is $$25.40\times1000/600\approx42.3\ (\mu m)$$

In addition, assuming that 75% of the above value, that is, 30 μm is the maximum movable amount, a deflection angle θ (deg) is $$\tan 2\theta=30/2000\approx0.015$$

Thus, $\theta\approx0.43$ (deg)

The reason the maximum movable amount of dot is 75% is as follows: For example, when two bits are used for control signals, the number of control signals for moving a dot is four. In order to establish continuity to dots formed by adjacent nozzles 18 in the above range, it is reasonable that the distance among the four dots is set to ¾ (=75%) of one dot pitch (42.3 μm). In this embodiment, the maximum movable amount is set at 75% of one dot pitch.

The results shown in FIGS. 3A and 3B indicate that, to obtain a deflection angle of 0.43 degrees, a bubble producing time difference of approximately 0.09 μm is needed. This corresponds to a resistance difference of approximately 6.75%. The above distance H is preferably set to the range of 0.5 millimeters to 5 millimeters, and is more preferably set to approximately a constant value in the range of 1 millimeters to 3 millimeters.

A value less than 0.5 millimeters as the distance H causes a small maximum movable amount of dot by deflective ejection of an ink droplet, so that a sufficient merit of the deflective ejection cannot be obtained. Conversely, in the case of a value greater than 5 millimeters as the distance H, the precision of a position to which the ink droplet is delivered tends to decrease (because it is presumed that an effect of air resistance to the ink droplet increases while the ink droplet is being delivered).

Next, an example of a case in which the direction of ejection of ink is changed is more specifically described below.

Figure 5:
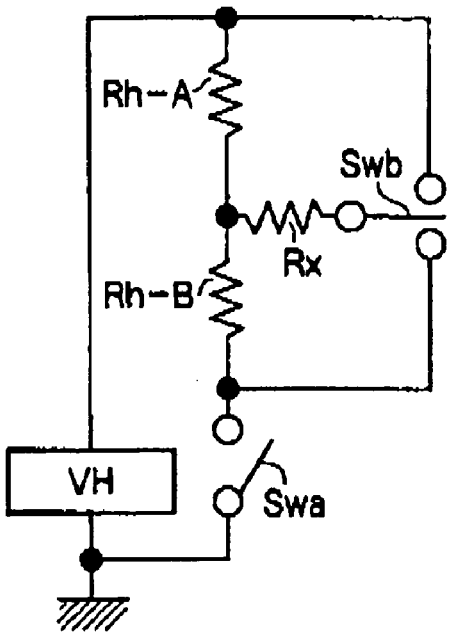
FIG. 5 is a schematic circuit diagram showing a first example in which the difference between the bubble producing times of bisected heating resistors can be set.

FIG. 5 is a schematic circuit diagram showing a first example in which the difference in bubble producing time of the heating resistors 13 can be set. In the first example, the printer-head chip 11 is controlled so that energies of different amounts can simultaneously be supplied. In other words, by simultaneously supplying the two heating resistors 13 with energies of different amounts, it is ensured that, for stable ejection of ink droplets, sufficient amounts of energies are supplied to the two heating resistors 13. Thus, stable ejection of ink droplets can be achieved while controlling the direction of ejection of the ink droplets.

Since the amount of energy supply to each heating resistor 13 only needs about half the amount of energy for stable ejection, problems as described in the related art and Earlier Applications 1, 3, and 4 do not occur. This is caused by a feature of the present invention in that the heating distributions of heating regions (regions on the two heating resistors 13) are changed while maintaining the total energy amount supplied to each heating resistor 13, without separately driving the plurality of heating resistors 13.

In FIG. 5, resistors Rh-A and Rh-B are the bisected heating resistors 13, respectively. The circuit is formed so that a current can flow into or from a path (midpoint) for connecting the resistors Rh-A and Rh-B. A resistor Rx is used to deflect an ejected ink droplet. The resistor Rx and a switch Swb function to control the amount of heat by the resistors Rh-A and Rh-B. A power supply VH is used to allow a current to flow in the resistors Rh-A, Rh-B, and Rx.

In FIG. 5, assuming that the circuit include no resistor Rx, or the switch Swb is not connected to either contact, when the switch Swa is turned on, a current flows from the power supply VH to the resistors Rh-A and Rh-B. No current flows in the resistor Rx. When the resistances of the resistors Rh-A and Rh-B are equal to each other, the amounts of heat generated in the resistors Rh-A and Rh-B are equal.

Conversely, when the switch Swa is turned on by connecting the switch Swb to either contact, the currents flowing in the resistors Rh-A and Rh-B have different values. Thus, the amounts of heat generated in both are different. For example, in FIG. 5, when the switch Swb is connected to the upper contact, currents flow in portions in which the Rh-A and Rx are connected to each other in parallel, and meet to form a combined current. The combined current flows in the resistor Rh-B. Thus, the current flowing in the resistor Rh-A is less than that flowing in the Rh-B. This can lower the amount of heat generated in the resistor Rh-A than that generated in the resistor Rh-B.

Here, in accordance with the resistance of the resistor Rx, the ratio between the amount of heat generated in the resistor Rh-A and the amount of heat generated in the resistor Rh-B can be set freely. This can set a difference in bubble producing time between the resistors Rh-A and Rh-B. Thus, in response thereto, the direction of ejection of ink droplet can be changed.

Similarly to the above case, when the switch Swb is connected to the lower contact, the reverse relationship holds, thus enabling the current flowing in the resistor Rh-A to be greater than that flowing in the resistor Rh-B.

In order to set a difference of 6.75%, the relationship between Rh (=Rh-A=Rh-B) and Rx is $$(Rh\times Rx)/(Rh\times(Rh+Rx))=Rx/(Rh+R)=1-0.0675=0.9325$$

Hence, $Rx\approx13.8\times Rh$

Therefore, in a circuit equivalent to the circuit in FIG. 5, when the bisected heating resistors 13 are connected to each other, the switching of the switch Swb can change the currents flowing in the bisected heating resistors 13. This can set a difference in bubble producing time between the resistors Rh-A and Rh-B, so that the direction of ejection of ink droplet can be changed.

Figure 6:
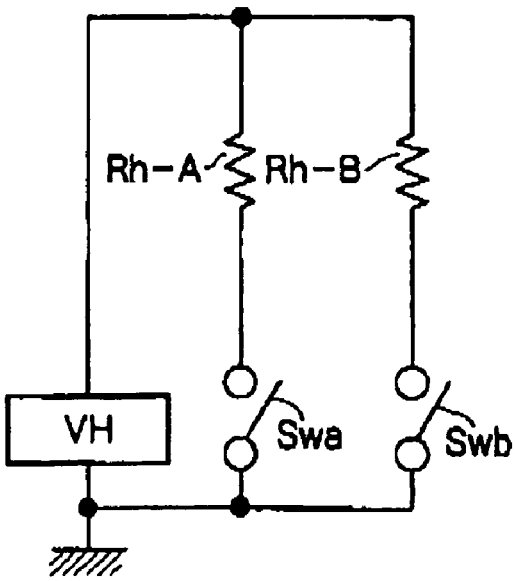
FIG. 6 is a schematic circuit diagram showing a second example in which the difference between the bubble producing times of bisected heating resistors can be set.

FIG. 6 is a schematic circuit diagram showing a second example in which the difference in bubble producing time between the bisected heating resistors 13 can be set. In the second example, the circuit is controlled so that energies of equal or similar amounts can be supplied to the bisected heating resistors 13 at different times.

Also, by using this technique, the total amount of energy supplied to the heating resistors 13 when an ink droplet is ejected can be maintained to an amount at which the ink droplet can stably be ejected. Thus, stable ejection of the ink droplet can be performed, and by setting a difference in supply of energy to each heating resistor 13, a feature of the present invention can be obtained in that the heating distributions of heating regions are changed while maintaining the total energy amount supplied to each heating resistor 13.

In FIG. 6, the resistors Rh-A and Rh-B are the bisected heating resistors 13, respectively. When only a switch Swa is turned on, a current can flow only in the resistor Rh-A. When only a switch Swb is turned on, a current can flow only in the resistor Rh-B.

In this circuit structure, by turning on the switches Swa and Swb at different times, a difference can be set between a time in which an ink droplet on the resistor Rh-A comes to a boil and a time in which an ink droplet on the resistor Rh-B comes to a boil.

Figure 7:
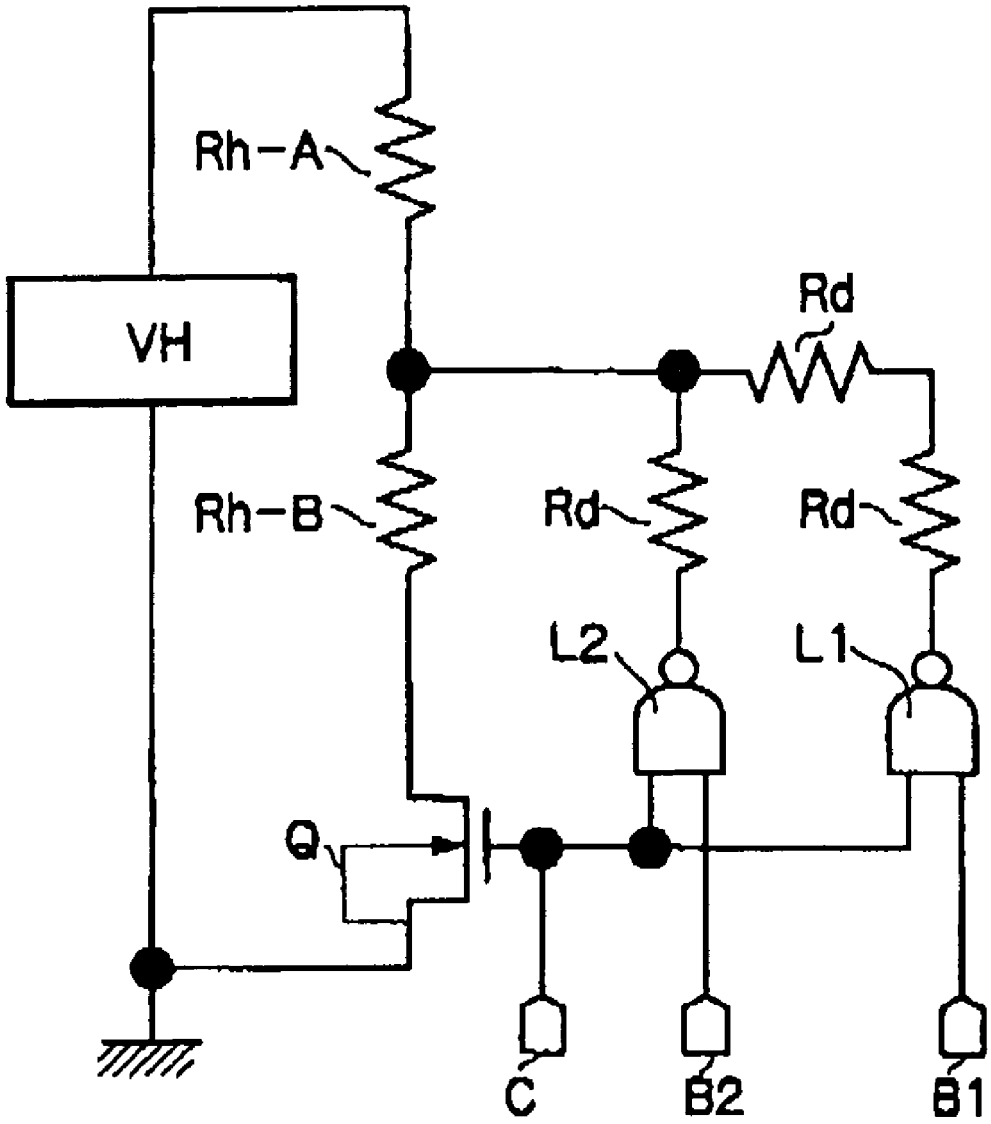
FIG. 7 is a schematic circuit diagram showing a third embodiment in which the difference between the bubble producing times of bisected heating resistors can be set.

FIG. 7 is a schematic circuit diagram showing a third example in which the difference in bubble producing time between the bisected heating resistors 13 can be set. In the third example, the difference in current between resistors Rh-A and Rh-B can be set to four types, whereby four directions in which an ink droplet can be ejected can be set.

In FIG. 7, the resistors Rh-A and Rh-B are the bisected heating resistors 13, respectively. In this example, their resistances are equal to each other. The circuit is formed so that a current can flow into or from a path (midpoint) for connecting the resistors Rh-A and Rh-B. Three resistors Rd are used to change a direction in which an ink droplet can be ejected. A transistor Q functions as a switch for the resistors Rh-A and Rh-B. The circuit includes an input portion C from which a binary control input signal ("1" only when a current may flow) is input. The circuit includes binary-input C-MOS/NAND gates L1 and L2, and input portions B1 and B2 from which binary signals ("0" or "1") for the NAND gates L1 and L2 are input. The NAND gates L1 and L2 are supplied with power from a power supply VH. The three resistors Rd, the transistor Q, the input portion C, and B1 and B2, and the NAND gates L1 and L2 function to control the amounts of energies generated in the resistors Rh-A and Rh-B.

Here, between the resistor Rx shown in FIG. 5 and the resistor Rd shown in FIG. 7, the following relationship holds:

$$Rx=2Rd/3$$

Therefore, when Rd≈1.5×13.8×Rh=20×Rh, a difference of 6.75% can be set.

At first, in FIG. 7, when is are input to the input portions B1 and B2, and "1" is input to the input portion C, inputs to the NAND gates L1 and L2 are 1s, so that the outputs of the NAND gates L1 and L2 are 0s. Thus, no current flows in the resistor Rd, and a current caused by a power supply VH flows only in the resistors Rh-A and Rh-B. Since the resistors Rh-A and Rh-B have equal resistances, the currents flowing in the resistors Rh-A and Rh-B are equal to each other.

Next, when "0" is input to the input portion B1, "1" is input to the input portion B2, and "1" is input to the input portion C, the outputs of the NAND gates L1 and L2 are "1" and "0", respectively. Thus, a current flows in the NAND gate L1, while no current flows in the NAND gate L2. In this case, the current flowing in the resistor Rh-B is 2Rd/(Rh+2Rd) when the current flowing in the resistor Rh-A is set to 1. Here, when Rd≈20.7Rh, 0.977 (approximately 2.3% decrease) can be obtained.

Also, when "1" is input to the input portion B1, "0" is input to the input portion B2, and "1" is input to the input portion C, the outputs of the NAND gates L1 and L2 are "0" and "1", respectively. Thus, no current flows in the NAND gate L1, while a current flows only in the NAND gate L2. In this case, the current flowing in the resistor Rh-B is Rd/(Rh+Rd) when the current flowing in the resistor Rh-A is set to 1. When Rd≈20.7Rh, 0.954 (approximately 4.6% decrease) can be obtained.

When 0s are input to the input portions B1 and B2, and "1" is input to the input portion C, both the outputs of the NAND gates L1 and L2 are 1s. Thus, currents flow in both C-MOS/NAND gates L1 and L2. In this case, the current flowing in the resistor Rh-B is 2Rd/(3Rh+2Rd) when the current flowing in the Rh-A is set to 1. When Rd≈20.7Rh, 0.933 (approximately 6.7% decrease) can be obtained.

The circuit is formed so that the current flowing from the resistor Rd to the NAND gate L1, and the current flowing from the resistor Rd to the NAND gate L2 can flow into the ground of a power-circuit for driving the C-MOS/NAND gates L1 and L2, which is not shown in FIG. 7.

FIG. 8 is a table showing the above results. As shown in FIG. 8, in response to the inputs to the input portions B1 and B2, the current flowing in the resistor Rh-B with respect to the current flowing in the resistor Rh-A can be changed.

In the circuit in FIG. 7, in a case in which a position obtained by inputting is to the input portions B1 and B2 is used as a reference position of dot, when "0" is input to the input portion B1 and "1" is input to the input portion B2, a deflection amount corresponding to 25% of one dot pitch can be obtained. When "1" is input to the input portion B1 and "0" is input to the input portion B2, a deflection amount corresponding to 50% of one dot pitch can be obtained. When 0s are input to the input portions B1 and B2, a deflection amount corresponding to 75% of one dot pitch can be obtained.

Figure 9:
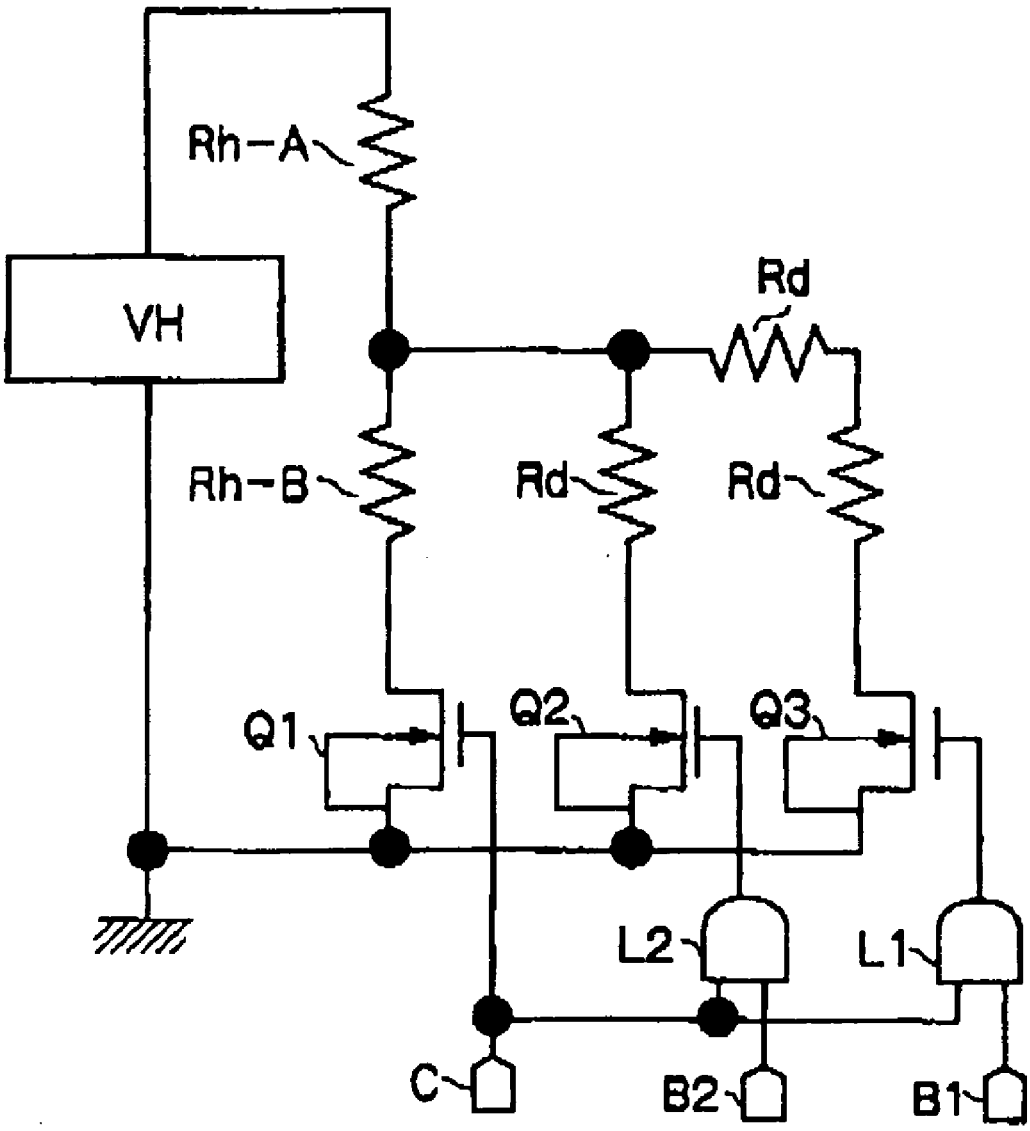
FIG. 9 is a schematic circuit diagram showing a fourth embodiment in which the difference between the bubble producing times of bisected heating resistors can be set.

FIG. 9 is a schematic circuit diagram showing a fourth example in which the difference in bubble producing time between the bisected heating resistors 13 can be set. FIG. 9 also shows a modification of the circuit shown in FIG. 7.

In the circuit in FIG. 7, since the voltage of the power supply VH is applied to the C-MOS/NAND gates L1 and L2, (high withstand voltage) PMOS transistors that are usable even at the voltage of the power supply VH must be used as the C-MOS/NAND gates L1 and L2, thus limiting the degree of freedom in selection of transistors in design. Accordingly, as shown in FIG. 9, transistors Q2 and Q3 of a type similar to that of a transistor Q1 are provided and each transistor can be driven at a low voltage. This can lower driving voltages for gates L1 and L2 (AND gates in FIG. 9). Three transistors Rd, the transistors Q1, Q2, and Q3, input portions C, B1, and B2, and the AND gates L1 and L2 function to control the amounts of heat generated in the resistors Rh-A and Rh-B.

Also, although the resistors Rh-A and Rh-B in the circuit in FIG. 7 are set to have equal resistances, in the circuit in FIG. 9, the resistance of the resistor Rh-A is set to be smaller than that of the Rh-B.

In this condition, when the transistors Q2 and Q3 are not in operation (a state in which no currents flow in the three resistors Rd), and currents flow in the resistors Rh-A and Rh-B, respectively, the currents flowing in the resistors Rh-A and Rh-B have equal values. Thus, the resistor Rh-A generates the amount of heat less than that by the resistor Rh-B because the resistor Rh-A has a resistance less than that of the resistor Rh-B. In this case, setting is established so that an ejected ink droplet can be delivered to a position which is away half of the maximum movable amount of ink droplet from a reference position of delivery.

Figure 10:
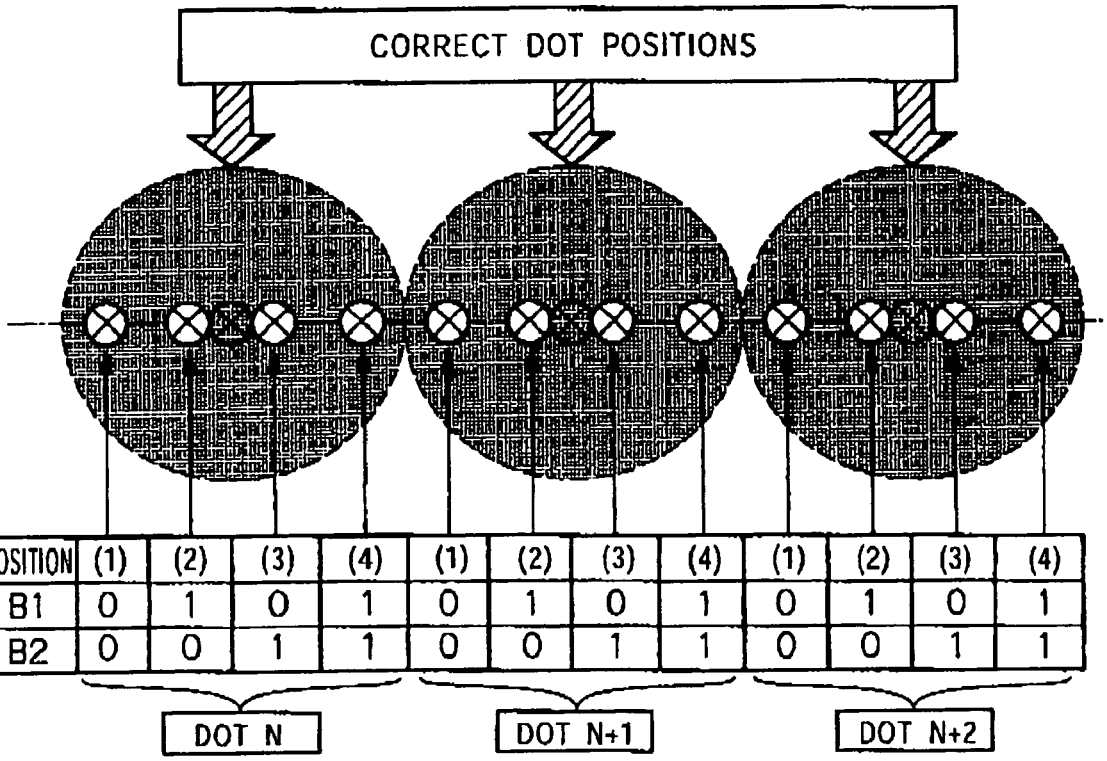
FIG. 10 is an illustration of the values of inputs B1 and B2 in FIG. 9, and positions of delivered droplets.

FIG. 10 is an illustration of the values of inputs B1 and B2 and positions to which ink droplets are delivered. As shown in FIG. 10, in this embodiment, the position to which the ink droplet is delivered can be changed to four. When 0s are input to the input portions B1 and B2, the ink droplet can be delivered on the leftest in FIG. 10 (default).

When "1" is input to the input portion B1 and "0" is input to the input portion B2, currents also flow in the two resistors Rd connected in series to the transistor Q3 (no current flows in the resistor Rd connected to the transistor Q2). As a result, the current flowing in the resistor Rh-B is smaller than that obtained when 0s are input to the input portions B1 and B2. However, also in this case, the current flowing in the resistor Rh-A is smaller than that flowing in the resistor Rh-B.

Next, when "0" is input to the input portion B1 and "1" is input to the input portion B2, a current flows in the resistor Rd connected to the transistor Q2 (no current flows in the two resistors Rd connected in series to the transistor Q3). As a result, the current flowing in the resistor Rh-B is further smaller than that obtained when "1" is input to the input portion B1 and "0" is input to the input portion B2. In this case, the current flowing in the resistor Rh-B is smaller than that flowing in the resistor Rh-A.

When is are input to the input portions B1 and B2, currents flow in the three transistors Rd connected to the transistors Q2 and Q3. As a result, the current flowing in the resistor Rh-B is further smaller than that obtained when "0" is input to the input portion B1 and "1" is input to the input portion B2.

By using the above technique, two positions, namely, right and left positions to which an ink droplet can be delivered are set with respect to the correct position to which the ink droplet can be delivered. In response to the values of inputs to the input portions B1 and B2, an arbitrary position can be set as the position to which the ink droplet is delivered.

In the circuit shown in FIG. 7, a maximum of 75% of one dot pitch can be moved with respect to a position to which an ink droplet is delivered which is used as a reference. However, in this case, as described above, an angle at which the ink droplet is ejected has a deflection angle of 0.86 degrees with respect to the vertical line.

In the example in FIG. 9, the inputs to the input portions B are represented by two bits, that is, "0" and "0", "0" and "1", "1" and "0", and "1" and "1". When the position to which the ink droplet can be delivered is moved based on the 2-bit value, one dot pitch must be divided into three. In other words, four positions are formed as the position to which the ink droplet can be delivered.

In the circuit shown in FIG. 9 (also as in the example in FIG. 7), when the inputs to the input portions B1 and B2 are changed from 0s to is, the angle at the ink droplet is ejected only needs to change by 0.86 degrees. Since a value corresponding to the difference in resistance at this time is 6.75%, as described above, a resistor may be used in which the relationship holds:

$$\text{Resistance of } Rh\text{-}B = \text{Resistance of } Rh\text{-}A \times 1.0675$$

Figure 11:
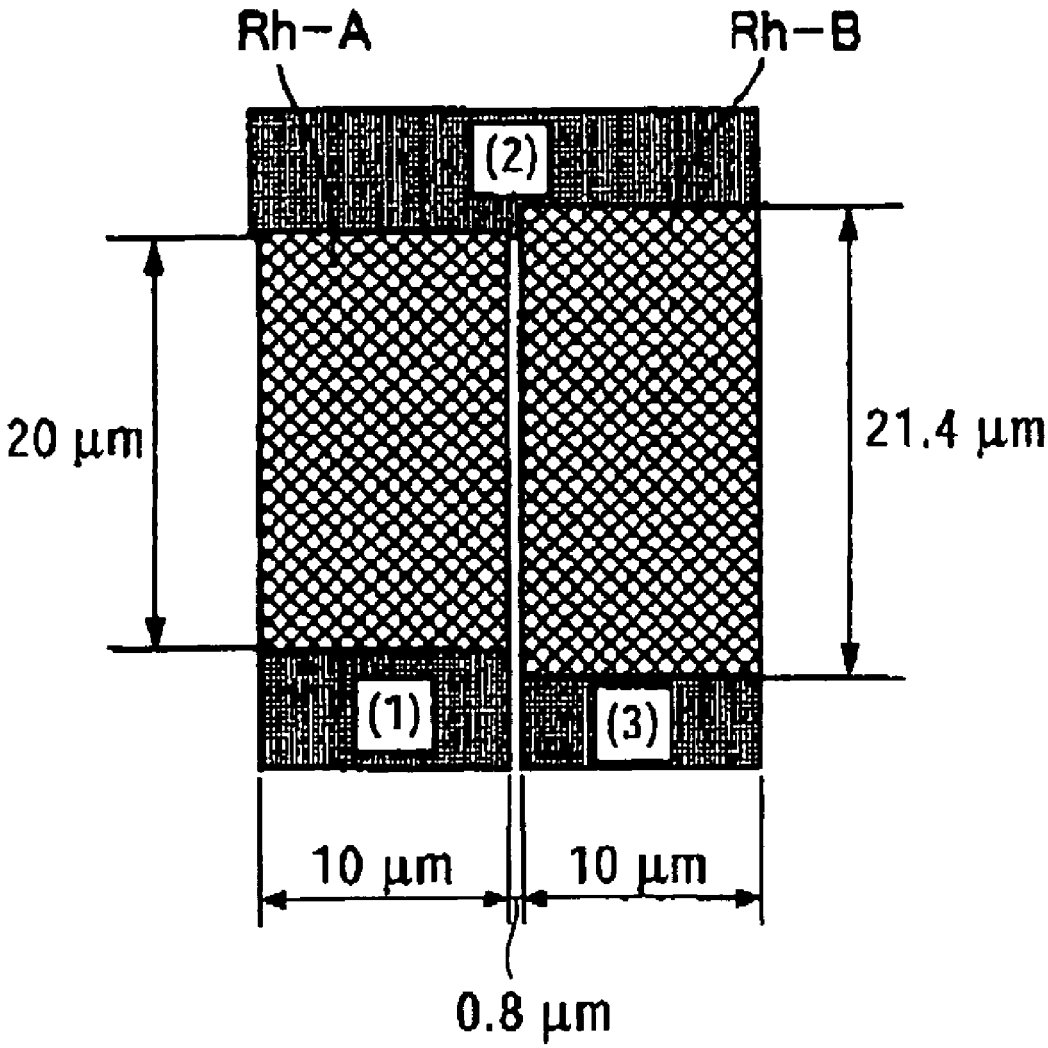
FIG. 11 is a plan view showing the specific shape of the circuit shown in FIG. 9.

FIG. 11 is a plan view showing resistors Rh-A and Rh-B that satisfy the above relationship. In the example in FIG. 11, the resistors Rh-A and Rh-B have equal widths (10 μm). The resistor Rh-A has a longitudinal length (the vertical length in FIG. 11) of 20 μm, and the resistor Rh-B has a longitudinal length of 21.4 μm.

In FIG. 11, a portion (1) is connected to the power supply VH in FIG. 9, a portion (2) is connected to the drain of the transistor Q1 in FIG. 9, and a portion (3) is connected to the drains of both transistors Q2 and Q3 in FIG. 9. These connections are not shown in FIG. 11.

In the example in FIG. 11, the area ratio between the resistors Rh-A and Rh-B is $$21.4/40 = \text{approximately } 1.0675$$

Next, in this embodiment, the case of correcting a shift in the position to which the ink droplet is delivered is described below.

Figure 12:
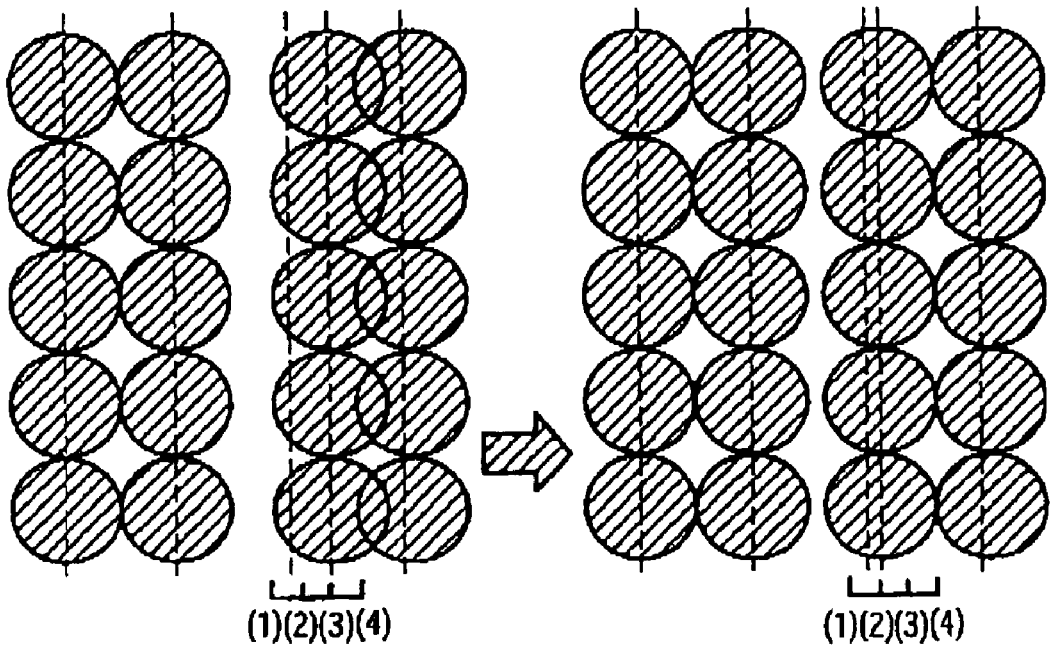
FIG. 12 is an illustration of a first modification to which the present invention is applied.

FIG. 12 is an illustration of a first modification in which this embodiment is used, and shows positions by the head chip 11 in which ink droplets are delivered. In FIG. 12, the horizontal direction is the direction in which the nozzles 18 are arranged, and the vertical direction is the direction in which the printing paper is fed. Also, the left side shows a state obtained before changing the positions to which the ink droplets are delivered, and the right side shows a state obtained after changing the positions to which the ink droplets are delivered.

In FIG. 12, a column of the positions to which the ink droplets are delivered can be horizontally moved to four positions ((1) to (4) in FIG. 12). The position by default to which each ink droplet is delivered is set in position (3) among positions (1) to (4). Similarly to the above case, in one position, the position which each ink droplet is delivered can be moved by only 25% of one dot pitch.

On the left side in FIG. 12, in all the first to four columns from the left, the ink droplets are delivered by the above-described main operation controller. In this case, the third column from the left of the positions to which the ink droplets are delivered is off to the right. Accordingly, a white stripe is formed between the second column and the third column and printing quality deteriorates.

In such a case, by leaving the first, second, and fourth columns of the default positions unchanged, and only moving the third column to the left, the white stripe between the second column and the third column can be reduced. In FIG. 12, by moving only the third column from position (3) to (2), that is, to the left by 25% of one dot pitch, the third column can be positioned near the center between the second column and the fourth column.

The right side in FIG. 12 shows a state in which, by shifting the third column from position (3) to (2), the third column is moved by 25%. In this manner, the ink droplets in the third column can be brought close to the center between the second column and the fourth column. This can make the white stripe unclear.

On the right side in FIG. 12, the first, second, and fourth columns from the left are formed by delivering ink droplets from the main operation controller. However, the third column from the left is formed such that, by using the sub operation controller to eject ink droplets having flying characteristics different from those of ink droplets by the main operation controller, a direction in which the ink droplets are delivered is changed, whereby positions to which the ink droplets are delivered are changed from the positions ((3) in FIG. 12) by the main operation controller to the more left side ((2) in FIG. 12).

When dots are formed appearing as overlapping stripes due to a narrow interval between two columns of positions to which ink droplets are delivered, conversely to the above case, the columns of positions may be moved so that the interval is widened.

When this technique is performed, in the printer itself or in the printer-head chip 11, for the ink cell 12 corresponding to each nozzle 18, by storing data for correcting a shift in a position to which an ink droplet is delivered, for example, data on inputs to the input portions B1 and B2 in the above example, the supply of energy to each heating resistor 13 in each ink cell 12 may be controlled in accordance with the stored data.

Also, when the circuit shown in FIG. 6 is employed, for each nozzle 18, by setting and storing data on a difference between the time required for the ink droplet on one heating resistor 13 to boil and the time required for the ink droplet on the other heating resistor 13 to boil, the supply of energy to each heating resistor 13 in each ink cell 12 may be controlled in accordance with the stored data.

In this manner, when some nozzles 18 in the printer-head chip 11 cause a shift in positions to which ink droplets are delivered, or some of the printer-head chips 11 in the line head cause a shift in positions to which ink droplets are delivered, the shift in the positions can be corrected.

Figure 19A:
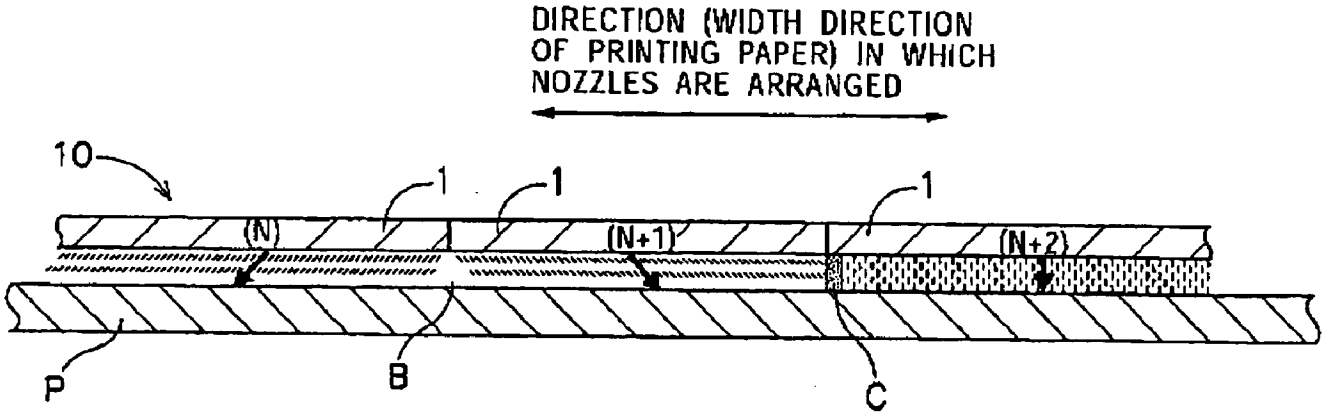
FIGS. 19A and 19B are a sectional view and plan view showing the state of an image printed by the line head shown in FIG. 18.
Figure 19B:
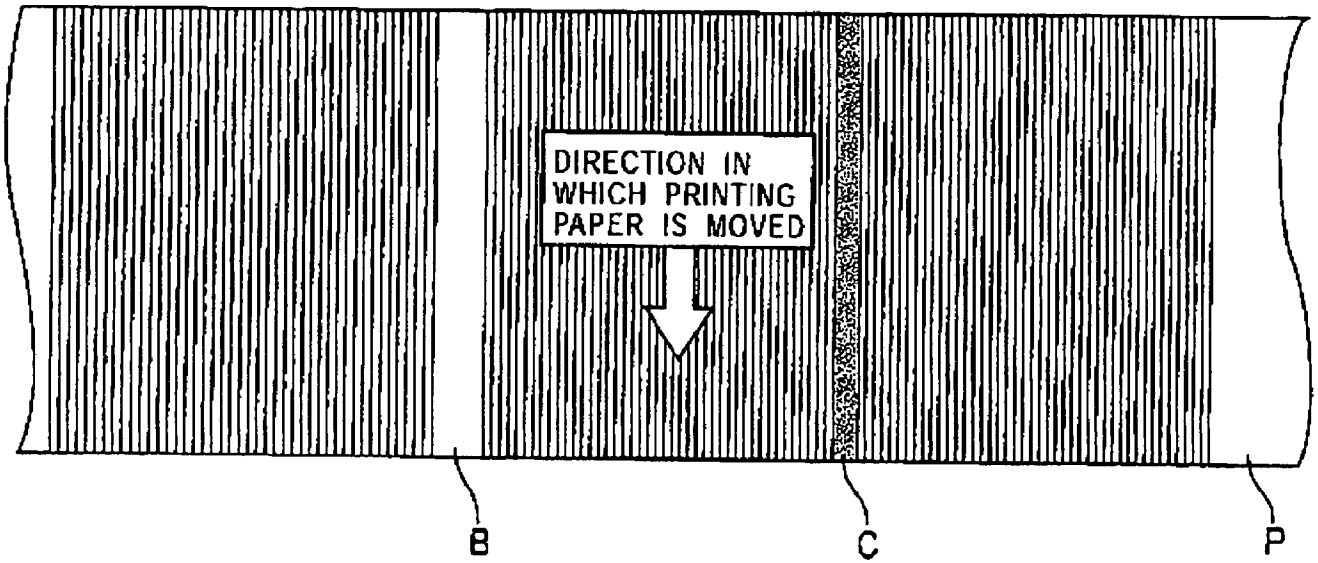

Also, when two adjacent printer-head chips 1 in the line head, as shown in FIGS. 19A and 19B, have therebetween a shift in positions to which ink droplets are delivered, the shift in the positions can be corrected.

FIGS. 19A and 19B are used for description. In this case, regarding the N-th printer-head chip 1, a direction in which ink droplets are delivered from all the nozzles 18 may be changed to the right by a predetermined amount, and regarding the (N+1)-th printer-head chip 1, a direction in which ink droplets from all the nozzles 18 are delivered may be changed to the left by a predetermined amount. Definitely, a direction in which ink droplets from some of the nozzles 18 are delivered may be changed.

Next, a case in which printing quality is increased by using this embodiment is described below.

In the case of the line head, the positions of the nozzles 18 of each printer-head chip 11 are fixed beforehand. Thus, positions to which ink droplets are delivered are determined beforehand. For example, for a resolution of 600 dpi, the interval between the nozzles 18 is 42.3 micrometers.

Conversely, in the case of the serial head, by moving the head a plural number of times in one line in order to perform printing, the resolution can be relatively easily changed.

For example, in the case of providing a serial head of 600 dpi (the interval between the nozzles 18 is 42.3 micrometers), by printing a line and subsequently re-printing an identical line, and controlling the dots of the re-printed line to be disposed in the intermediate positions of the dots of the first printed line, an image having a resolution of 1200 dpi can be printed.

The above technique cannot be used in the line head because it is not moved in the width direction of the printing paper.

However, by applying this embodiment, the resolution can substantially be increased, thus increasing printing quality.

Figure 13:
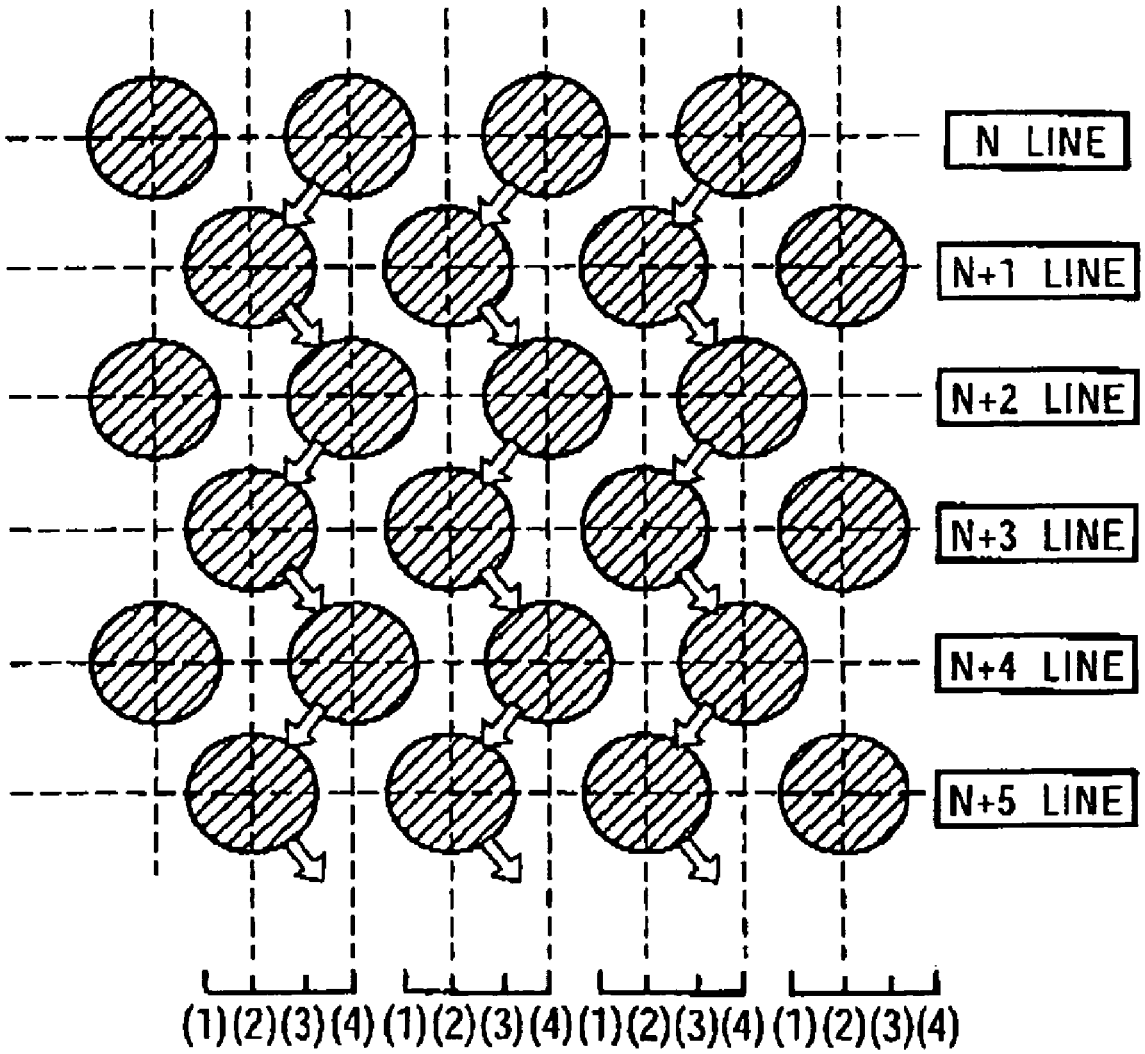
FIG. 13 is an illustration of a second modification to which the present invention is applied.

FIG. 13 is an illustration of a second modification in which this embodiment is used. The second modification is an example of a dot arrangement based on dot interleaving in which the dot pitch in each line is set to be constant, and in the next line its dots are arranged in the intermediate positions of the first line. In FIG. 13, each position to which an ink droplet is delivered can be changed to four points (1) to (4), and point (4) is set by default.

In FIG. 13, the first N line, ink droplets are delivered to the default position (4).

In the next N+1 line, by changing, from positions (4) to (2), all positions to which ink droplets are delivered are changed, the ink droplets are delivered to positions moved to the left by 50% of one dot pitch. In the N+2 line, ink droplets are delivered to positions identical to those for the N line. In other words, in N, N+2, N+4, . . . lines (even-numbered lines), ink droplets are ejected by the main operation controller and are delivered to (4). In N+1, N+3, N+5, . . . lines (odd-numbered lines), ink droplets are ejected and deflected by the sub operation controller and are delivered to position (2).

In this manner, in N, N+2, N+4, . . . lines (even-numbered lines), the ink droplets are delivered based on (4), and in N+1, N+3, N+5, . . . lines (odd-numbered lines), ink droplets are delivered based on position (2).

Thus, in two adjacent lines, two groups of positions to which ink droplets are delivered are alternately shifted from each other by 50% of one dot pitch. By performing this type of printing, a substantial resolution can be increased.

Instead of moving, in all the lines, positions to which ink droplets are delivered, the positions may be moved in each set of several lines. Also, the amount of movement from a default dot position is not particularly limited.

When the above control is performed, for each line, by storing data on differences in supplying energy to each heating resistor 13, the supply of energy to the heating resistor 13 may be controlled in accordance with the stored data.

Figure 14:
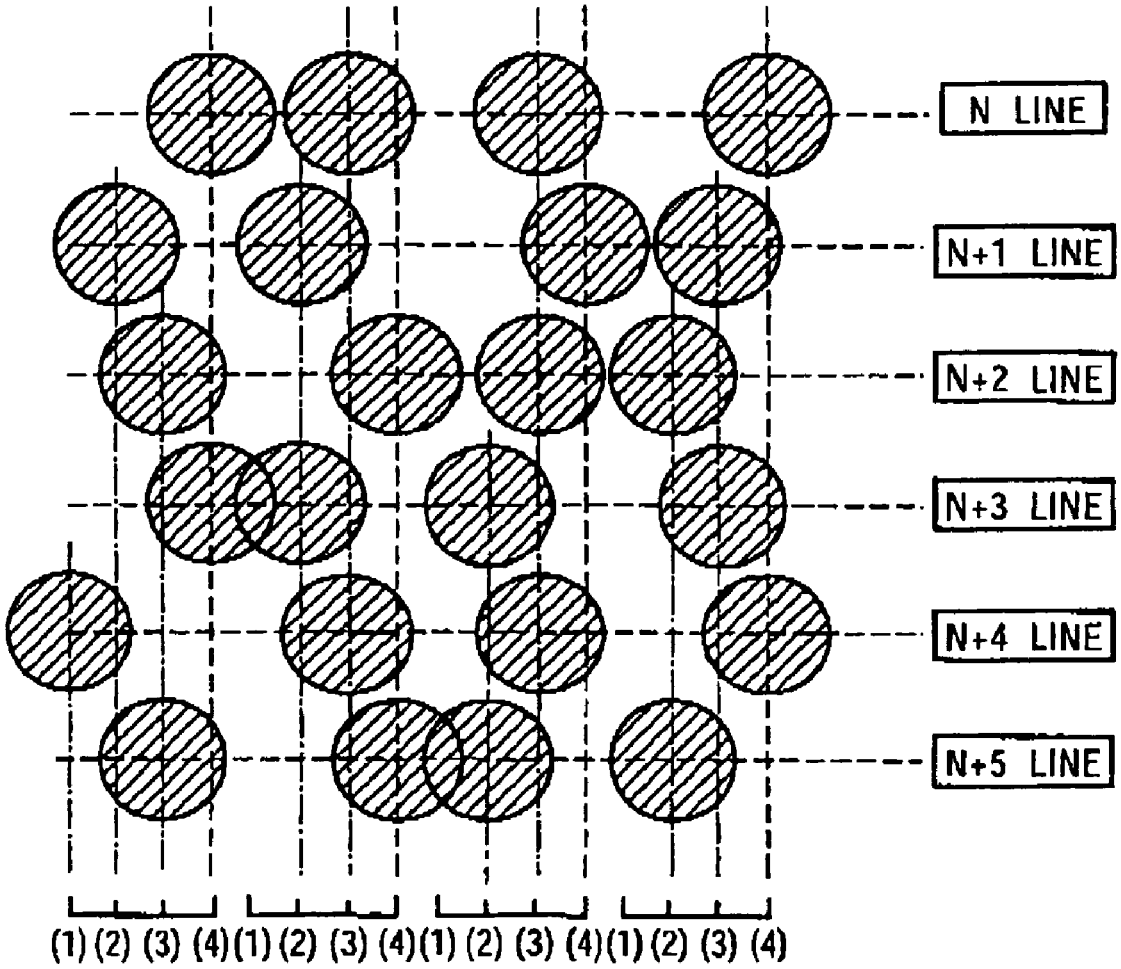
FIG. 14 is an illustration of a third modification to which the present invention is applied.

FIG. 14 is an illustration of a third modification in which this embodiment is used and in which a technique similar to dithering is used.

Dithering means that, in order to weaken unnaturalness generated when the spatial resolution of pixels in a sampled image is insufficient, when the original image is quantized, the quantization is performed, with slight noise and high-frequency signal superimposed in an input signal beforehand.

What is shown by FIG. 14 differs from dithering in a narrow sense, but has an effect similar to dithering. In FIG. 14, default positions to which ink droplets are delivered are set in (4). In FIG. 14, it is assumed that dot size is sufficiently small.

In the case in FIG. 14, binary-bit values are output by a pseudorandom function generator and are added to input signals to the input portions B1 and B2. This can appropriately change a position to which an ink droplet is delivered.

For example, in the N line, the first and fourth ink droplets from the left are delivered to default position (4) by the main operation controller, and each of the second and third ink droplets from the left is delivered to position (3) which is moved to the left by 25% of one dot from the default position.

The above technique can also increase printing quality.

Figure 15:
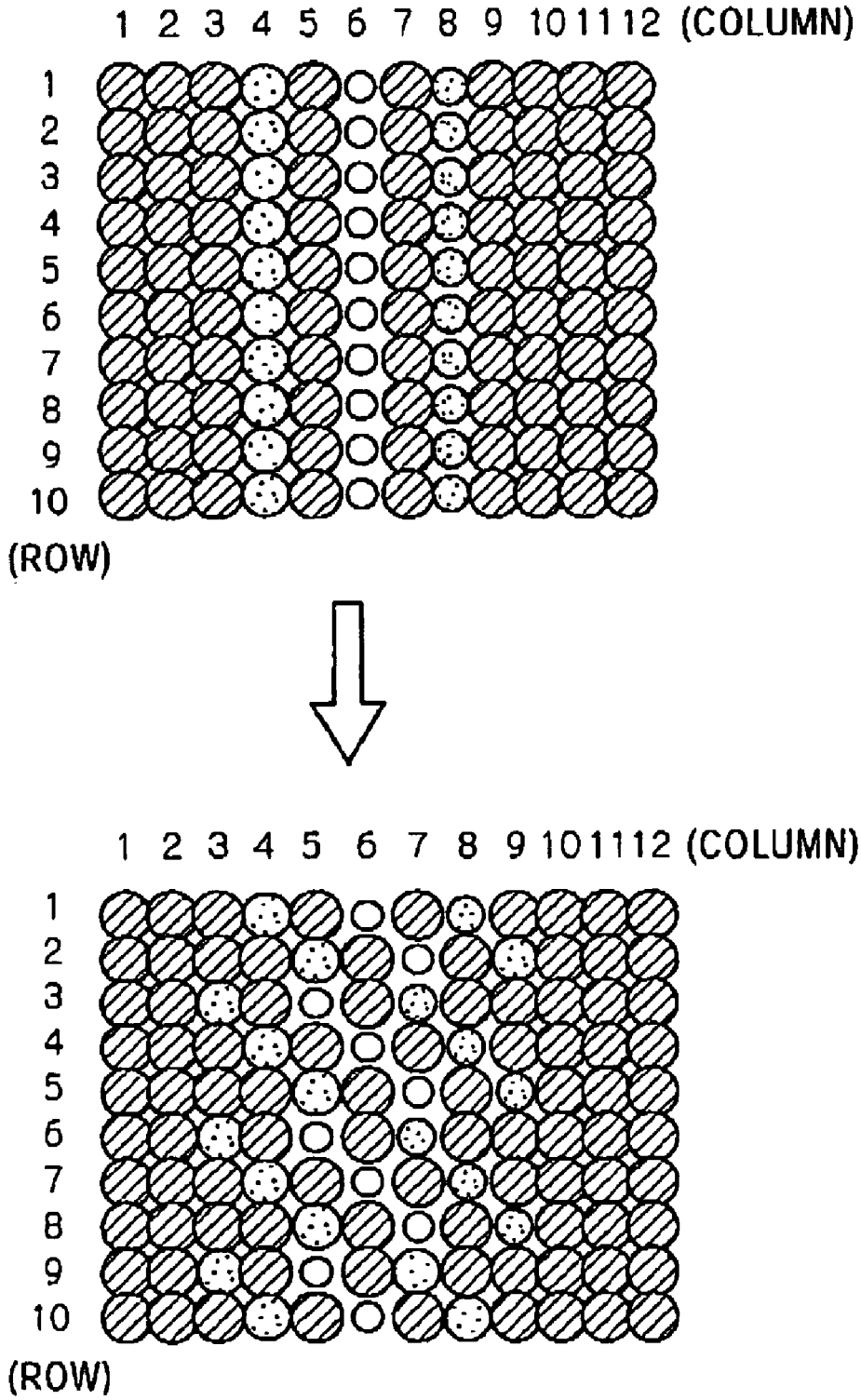
FIG. 15 is an illustration of a fourth modification to which the present invention is applied.

FIG. 15 consists of illustrations of a fourth modification in which this embodiment is used and shows a dot averaging process.

In FIG. 15, the upper illustration shows a state in which ink droplets are ejected without being deflected. The ink droplets are delivered by the main operation controller.

In the upper illustration in FIG. 15, the fourth and eighth columns of dots (whose insides are indicated by sets of points) indicate that the dots are smaller than the other columns of dots (whose insides are indicated by hatched lines). The sixth column of dots (whose insides are blank) indicate that the dots are much smaller than the fourth and eighth columns of dots.

In this case, when a dot averaging process is not performed, in the fourth, sixth, and eighth columns, small dots are consecutively formed in a direction (the vertical direction in FIG. 15) in which the printing paper is fed, so that density nonuniformity (vertical stripe) appears.

Accordingly, in this case, the dot averaging process is performed by using the sub operation controller.

In the lower illustration in FIG. 15, from, for example, the nozzle 18 corresponding to the sixth column (the nozzle 18 positioned above the sixth column), only the main operation controller is used to deliver ink droplets in the sixth column, as in the upper illustration in FIG. 15. However, in the second column, by using the sub operation controller, ink droplets are deflected to the right and are delivered to positions corresponding to the dot positions in the seventh column. In the third column, by using the sub operation controller, ink droplets are deflected to the left and are delivered to positions corresponding to the dot positions in the, fifth column.

By using this technique, the nozzle 18 corresponding to the sixth column is controlled to deliver ink droplets not only in the sixth column but also in another column (the fifth column or the seventh column in this example), and is controlled so as not to deliver ink droplets in consecutive rows in one column. This also applies to ink droplets ejected from the nozzles 18 corresponding to the fourth and eighth columns.

In the above arrangement of dots, ink droplets ejected from the nozzles 18 corresponding to the fourth, sixth, and eighth columns are prevented from being delivered to consecutive rows in one column. This can prevent density nonuniformity from looking clearly and can increase picture quality.

Figure 16:
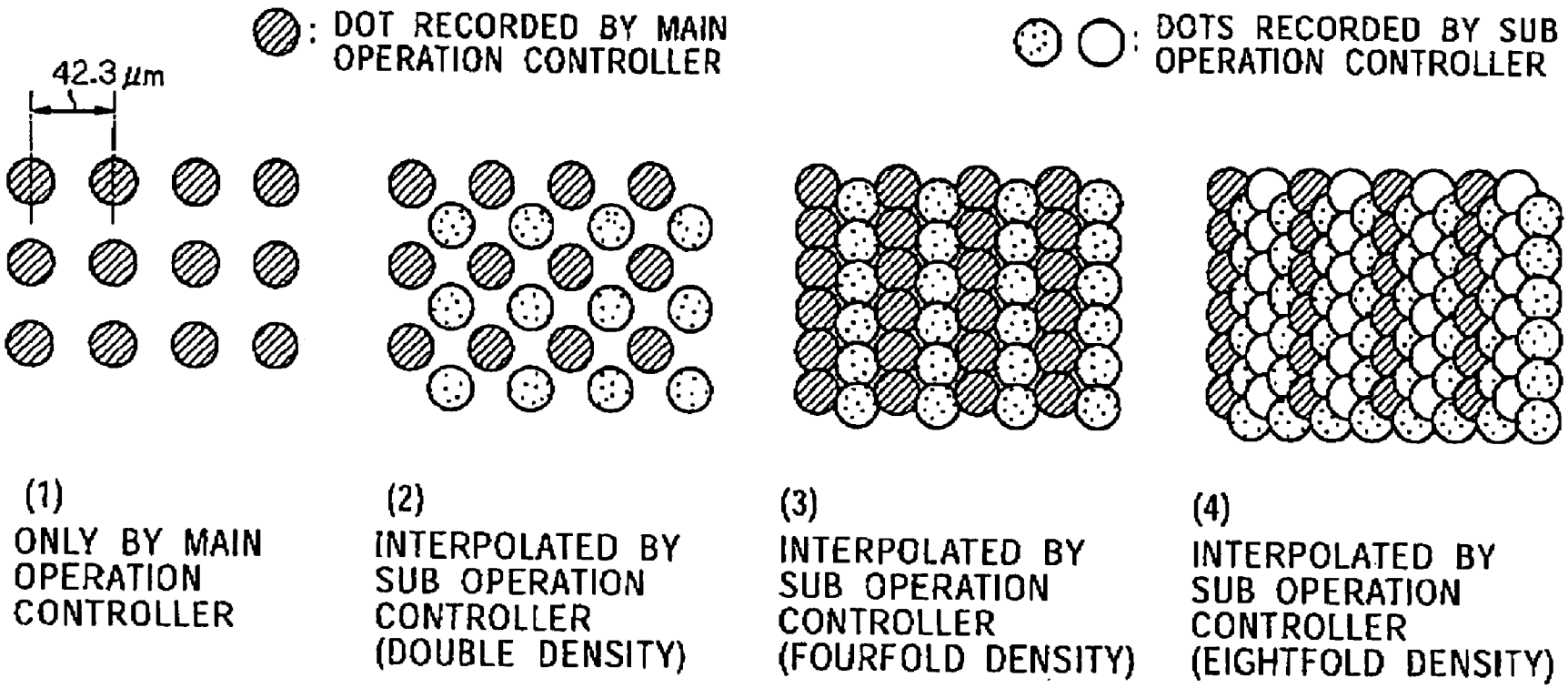
FIG. 16 is an illustration of a fifth modification to which the present invention is applied.

FIG. 16 illustrates a fifth modification in which this embodiment is used, and the formation of high resolution. In FIG. 16, it is assumed that the printer-head chip 11 has a resolution of 600 dpi (the interval between the nozzles 18 is 42.3 micrometers).

In FIG. 16, the case (1) shows that dots are formed by delivering ink droplets from the main operation controller. The dot pitch obtained when using only the main operation controller is equal to the interval between the nozzles 18 in the printer-head chip 11, that is, 42.3 micrometers.

Unlike the case (1), the cases (2) to (4) show that, by using the sub operation controller to interpolate new dots in dots formed by the main operation controller, the printing resolution is increased.

For example, in the case (2), ink droplets are delivered by the main operation controller similarly to the case (1), and by using the sub operation controller to form new dots in dot formed by the main operation controller, the dot density is doubled. In this case, a method similar to that shown in FIG. 13 is used. The feeding pitch of printing paper is set to be half that in the case (1).

The portion (3) shows a state in which the dot density is quadrupled. To quadruple the dot density, at first, when the main operation controller is used to deliver ink droplets, the ink droplets are controlled to be delivered to the feeding direction of printing paper at a density double that used in the case (1) (i.e., the feeding pitch of printing paper is set to be half that used in the case (1)). In addition, by using the sub operation controller to deflect ink droplets, the ink droplets may be delivered at the density double that used in the case (2).

The portion (4) shows a state in which the dot density is octupled. By using the main operation controller, the dots are formed in the feeding direction of the printing paper at a density double that used in the case (1). This point is similar to dot formation by the main operation controller in the case (1).

In addition, by using the sub operation controller, ejected ink droplets are deflected and delivered so that three new columns of dots can be positioned between the dots formed by the main operation controller. The three columns of dots formed by the sub operation controller, which are positioned between two columns of dots formed by the main operation controller, are obtained such that, from the nozzle 18 corresponding to the left column of dots between two columns of dots formed by the main operation controller, ink droplets are ejected and deflected in two different right directions to form two columns among the three columns, and from the nozzle 18 corresponding to the right column of dots between the two columns of dots formed by the main operation controller, ink droplets are ejected and deflected to the left to form the other one column of dots among the three columns of dots.

As described above, when the printer-head chip 11 has a physical resolution of 600 dpi, printing at 600 dpi can be performed only by the main operation controller, as in the case (1). Also, the use of the sub operation controller enables printing at the double density (1200 dpi) as in the case (2), printing at the fourfold density (2400 dpi) as in the case (3), and printing at the eightfold density (4800 dpi) as in the case (4).

The above increase in resolution is particularly effective in a case in which dot diameter is small due to the interval between two nozzles 18.

Figure 17:
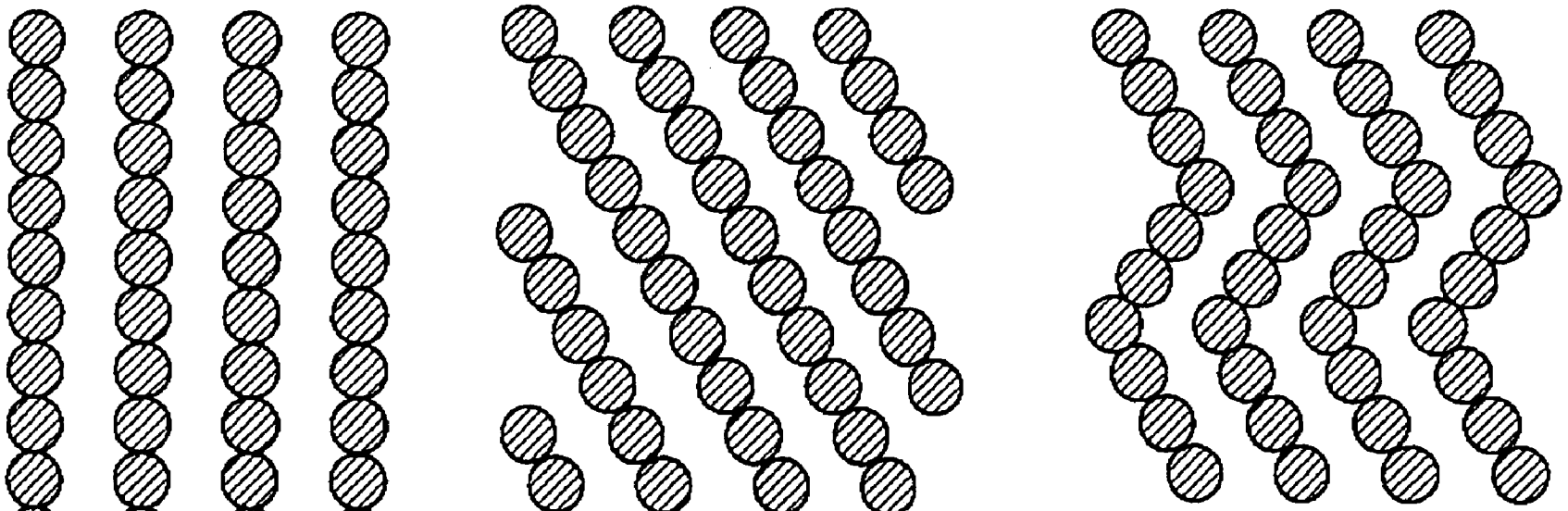
FIG. 17 is an illustration of a sixth modification to which the present invention is applied.
Figure 18:
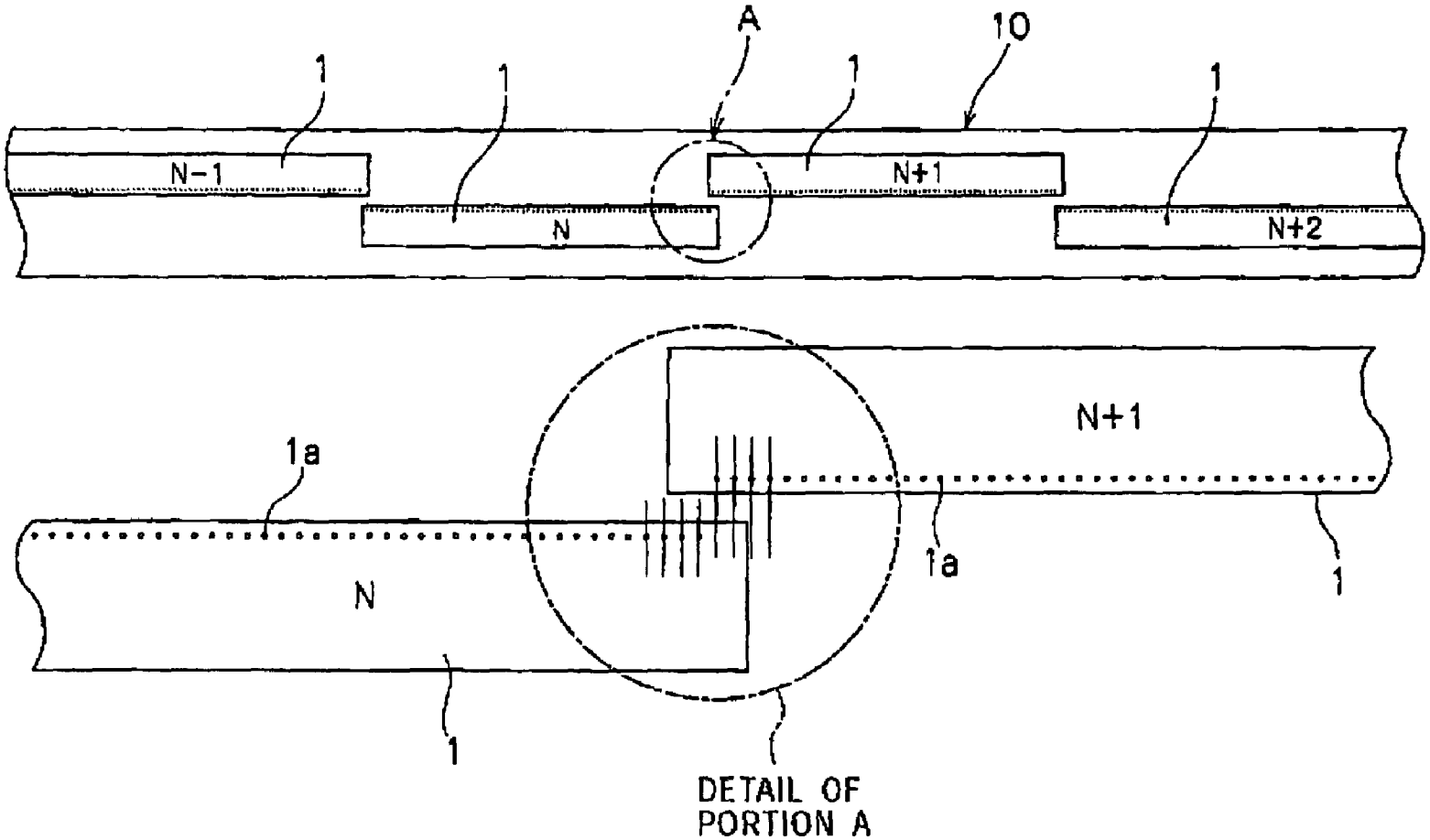
FIG. 18 consists of plan views showing a line head of the related art.

FIG. 17 illustrates a sixth modification in which this embodiment is used and which has a wobbled state.

In FIG. 17, example (1) shows dot formation only by the main operation controller, in which four columns of dots are arranged in parallel with the feeding direction of printing paper at intervals of the nozzles 18.

In FIG. 17, example (2) shows that columns of dots are obliquely formed by the sub operation controller. For example, in the first row, similarly to the example (1), dots are formed by the main operation controller. In the second row, by controlling the nozzles 18 to eject and deflect ink droplets to the right, dots are formed at the lower right portions to the first column of dots. In the third row, by increasing the amount of deflection from the nozzles 18 than that used in the second row, dots are formed at the lower right portions to the lower right portions to the second row of dots. In this manner, by gradually increasing the amount of deflection as the row number increases, oblique columns of dots can be formed as shown in the example (2). This dot formation prevents nonuniformity and stripes from looking clear.

In FIG. 17, example (3) shows that columns of dots are obliquely formed, similarly to the example (2). In the example (3), in the first row, similarly to the example (1), the main operation controller is used to form dots. In the second to fourth rows, similarly to the example (2), by controlling the nozzles 18 to eject and deflect ink droplets in the right in FIG. 17, dots are formed at the lower right portions to the upper column of dots. Next, in the fifth to seventh rows, by ejecting and deflecting ink droplets in the direction opposite to that in the second to fourth rows, that is, to the right in FIG. 17, dots are formed at the lower left portions to the upper column of dots. Dot arrangement in the eighth and subsequent columns is similar to that in the second and subsequent columns. As described above, by forming the columns of dots in a triangular form, stripes and nonuniformity can be prevented from looking clearly.

Up to which column of dots should obliquely be formed in a single direction, and from which column the dots should obliquely be formed in the opposite direction are arbitrary, and may be determined in accordance with a possible maximum amount of ink-droplet deflection, etc.

Printing methods such as the examples (2) and (3) in FIG. 16 are realized in a serial printer by reciprocally moving its head a great number of times, that is, overwriting. Conversely, in a line printer whose head does not move, it has been impossible to perform such wobbling. However, in the present invention, the printing methods are realized by using the sub operation controller.

One embodiment of the present invention has been described. The present invention is not limited to the above-described embodiment, but can be variously modified as follows:

(1) In the above-described embodiment, by changing currents to bisected heating resistors 13, the times (bubble producing time) required for ink droplets on the heating resistors 13 to boil can differ from each other. In addition, this can be combined with a technique in which the times in which currents are supplied to the bisected heating resistors 13 are controlled to differ.

(2) In the above-described embodiment, a case in which two heating resistors 13 are arranged in parallel in one ink cell 12 has been described. The reason of bisection is that the durability of the bisected heating resistors 13 is sufficiently proven and the circuit configuration can be simplified. However, the arrangement of the heating resistors 13 is not limited to the above case, but an arrangement in which at least three heating resistors 13 are arranged in parallel in one ink cell 12 may be used.

(3) In the above-described embodiment, the printer-head chip 11 and the line head for use in the printer are exemplified. However, the present invention is not limited to the printer, but can be applied to a device for ejecting a DNA-contained solution for detecting a biological sample.

(4) In the above-described embodiment, the heating resistors 13 are exemplified. However, heating elements composed of a substance other than a resistor, or other types of energy generators and bubble producers may be used.

(5) In the above-described embodiment, the bisected heating resistors 13 are exemplified. However, these plural heating resistors 13 do not always need to be physically separated.

In other words, even in the case of a heating resistor 13 composed of a single base, if it is one in which the distribution of energy in a bubble producing region (surface region) can be set to have a difference, for example, one in which the entire bubble producing region does not uniformly generate heat and in which a portion of the region and another portion can be set to have a difference in generating heat, it does not always need to be separated.

A main operation controller which ejects an ink droplet from the nozzle 18 by supplying uniform energy to the bubble producing region, and a sub operation controller in which, by setting a difference in energy distribution in the bubble producing region when it is supplied with energy, an ink droplet having a flying characteristic different from that of the ink droplet ejected by the main operation controller is ejected based on the difference from the nozzle 18, in other words, which controls the ink droplet ejected from the nozzle 18 to be delivered to a position different from the position of the ink droplet delivered by the main operation controller may be provided.

(6) For means of bubble production, the heating resistors 13 or the like are used to produce bubbles in the ink in the ink cells 12 by supplying thermal energy. The means of bubble production is not limited to this technique. For example, the means of bubble production may be such an energy supplying method that the ink (liquid) in the ink cells 12 generates heat by itself.

What the invention claimed is:

1. A liquid ejecting device comprising:

a liquid cell for containing liquid;

a plurality of bubble producing means for producing bubbles in the liquid in said liquid cell in response to energy being supplied to individual ones of the pluarlity of bubble producing means;

a nozzle for ejecting the liquid in said liquid cell; and wheren: a pseudorandom function generator output is used to at least partially determine a difference in energy supplied to the individual ones of the plurality of bubble producing means in the cell.

2. The liquid ejecting device of claim 1, wherein the density of droplets is 2400 DPI.

3. The liquid ejecting device of claim 1, wherein the density of droplets is 4800 DPI.

* * * * *